US006537463B2

(12) United States Patent
Iwasaki et al.

(10) Patent No.: US 6,537,463 B2
(45) Date of Patent: Mar. 25, 2003

(54) RESIN-BONDED MAGNET, ITS PRODUCT, AND FERRITE MAGNET POWDER AND COMPOUND USED THEREFOR

(75) Inventors: Katsunori Iwasaki, Saitama-ken (JP); Masahiro Tobise, Saitama-ken (JP); Yasunobu Ogata, Saitama-ken (JP); Mikio Shindo, Saitama-ken (JP); Hiroshi Okajima, Saitama-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 9 days.

(21) Appl. No.: 09/732,744

(22) Filed: Dec. 11, 2000

(65) Prior Publication Data

US 2002/0084001 A1 Jul. 4, 2002

(51) Int. Cl.[7] ..... H01F 1/11

(52) U.S. Cl. ..... 252/62.54; 252/62.57; 252/62.59; 252/62.63; 252/62.55; 148/301

(58) Field of Search ..... 252/62.63, 62.57, 252/62.55, 62.54, 62.59; 248/301

(56) References Cited

U.S. PATENT DOCUMENTS 5,186,766 A * 2/1993 Iriyama et al. ..... 148/301
5,658,396 A * 8/1997 Sakurada et al. ..... 148/301
6,284,150 B1 * 9/2001 Ogata et al. ..... 252/62.51 C
6,312,795 B1 * 11/2001 Yamamoto ..... 252/62.55

FOREIGN PATENT DOCUMENTS

| | | | |
|---|---|---|---|
| JP | 60-223095 | | 11/1985 |
| JP | 02-057663 | | 2/1990 |
| JP | 10-149910 | | 6/1998 |
| JP | 2000-260614 | | 9/2000 |
| WO | WO98/38654 | A1 | 9/1998 |
| WO | WO 99/38174 | * | 7/1999 |

* cited by examiner

*Primary Examiner*—C. Melissa Koslow
(74) *Attorney, Agent, or Firm*—Sughrue Mion, PLLC

(57) ABSTRACT

A resin-bonded magnet composed substantially of (a) an R—T—N-based magnetic powder having a basic composition of $R_{\alpha}T_{100-\alpha-\beta}N_{\beta}$, wherein R is at least one selected form the group consisting of rare earth elements including Y, T is Fe or Fe and Co, $5 \leqq \alpha \leqq 20$, and $5 \leqq \beta \leqq 30$, (b) a ferrite magnetic powder having a substantially magnetoplumbite-type crystal structure and a basic composition represented by $(A_{1-x}R'_x)O\square\square[(Fe_{1-y}M_y)_2O_3]$ by atomic ratio, wherein A is Sr and/or Ba, R' is at least one selected from the group consisting of rare earth elements including Y, La being indispensable, M is Co or Co and Zn, $0.01 \leqq x < 0.4$, $0.005 \leqq y \leqq 0.04$, and $5.0 \leqq n \leqq 6.4$, and (c) a binder. The ferrite magnet powder is preferably an anisotropic, granulated powder or an anisotropic, sintered ferrite magnet powder.

17 Claims, 12 Drawing Sheets

RESIN-BONDED MAGNET, ITS PRODUCT, AND FERRITE MAGNET POWDER AND COMPOUND USED THEREFOR

FIELD OF THE INVENTION

The present invention relates to a resin-bonded magnet useful for wide ranges of magnet applications such as various rotors, magnet rolls for electromagnetic developing-type printers and photocopiers, audio speakers, buzzers, attracting or magnetic field-generating magnets, which has a maximum energy product $(BH)_{max}$ at least equal to those of anisotropic, sintered ferrite magnets, improved magnetizability and/or heat resistance as compared with conventional resin-bonded rare earth magnets, as well as small unevenness in a surface magnetic flux density. The present invention also relates to a ferrite magnet powder and a compound both for such a resin-bonded magnet. The present invention further relates to a rotor and a magnet roll each constituted by such a resin-bonded magnet.

PRIOR ART

Recently R-Fe-N-H magnetic alloys including $Sm_2Fe_{17}N_x$(x=2–6) magnet materials (U.S. Pat. No. 5,186,766) have come to be used as magnet materials replacing resin-bonded rare earth magnets comprising an isotropic or anisotropic magnet powder containing an $Nd_2Fe_{14}B$ intermetallic compound as a main phase which have poorer magnetizability and high irreversible loss of flux, a measure of heat resistance, which is evaluated by a permeance coefficient. Resin-bonded rare earth magnets comprising $Sm_2Fe_{17}N_x$, however are insufficient in heat resistance and magnetizability to satisfy the recent needs of smaller size and higher performance for magnet applications. Therefore, their improvements are desired.

WO 98/38654 (PCT/JP98/00764) discloses an anisotropic, resin-bonded magnet composed of a ferrite magnet powder containing a hexagonal ferrite as a main phase and having a composition comprising 1–13 atomic % of A (at least one element selected from the group consisting of Sr, Ba, Ca and Pb, Sr being indispensable), 0.05–10 atomic % of R (at least one element selected from the group consisting of rare earth elements including Y and Bi, La being indispensable), 80–95 atomic % of Fe, and 0.1–5 atomic % of M (Co or Co and Zn). An example of this anisotropic, resin-bonded magnet is a ferrite magnet powder having coercivity iHc of 4.31 kOe for anisotropic, resin-bonded magnet, which is produced by dry-pulverizing a calcined body having such a composition as to provide a final composition of $Sr_{0.7}La_{0.3}Fe_{12-7}Co_{0.3}O_{19}$ (0.2% by weight of $SiO_2$ and 0.15% by weight of $CaCO_3$ were added before calcining) by a vibration mill, and then annealing the pulverized material at 1,000° C. for 5 minutes in the air. This anisotropic, resin-bonded magnet having $(BH)_{max}$ less than those of anisotropic, sintered ferrite magnets is not satisfactory for use as a substitute for anisotropic, sintered ferrite magnets.

Japanese Patent Laid-Open No. 60-223095 discloses a field magnet constituted by a resin-bonded magnet comprising predetermined proportions of a hard ferrite magnet powder and a rare earth element-cobalt magnet powder bonded by a binder resin, assembled into a magnetic field apparatus for bubble memory device having a temperature coefficient of magnetic flux density of −0.03%/°C. to −0.20%/° C. Though this field magnet has a temperature coefficient of a magnetic flux density in the above range, it fails to have improved heat resistance, magnetizability and the like.

"Rare Metal News No. 1936" issued on Feb. 8, 1999 describes that magnetic properties can be improved, for instance, to $(BH)_{max}$ of 4–5 MGOe corresponding to the level of anisotropic, sintered ferrite magnets, by mixing an anisotropic Sm-Fe-N magnet powder and a ferrite magnet powder at predetermined proportions. However, the above reference makes no specific mention of the composition of the ferrite magnet powder. Investigation by the inventors has revealed that when a conventional Sm—Fe—N magnet powder for resin-bonded magnets and usual ferrite magnet powder (e.g. Sr-ferrite magnet powder) are compounded at predetermined proportions and bonded with a binder resin, the resultant resin-bonded magnet has $(BH)_{max}$ of 3.3 MGOe or more, equal to or more than those of anisotropic, sintered ferrite magnets and improved magnetizability and/or heat resistance, which are important in practical applications of magnets, as well as improved uniformity in a surface magnetic flux density.

OBJECTS OF THE INVENTION

Accordingly, an object of the present invention is to provide a resin-bonded magnet having improved magnetizability and/or heat resistance as compared with those of conventional resin-bonded rare earth magnets and further small unevenness in a surface magnetic flux density.

Another object of the present invention is to provide a ferrite magnet powder and a compound both for such a resin-bonded magnet.

A further object of the present invention is to provide a rotor and a magnet roll each constituted by such a resin-bonded magnet.

SUMMARY OF THE INVENTION

The ferrite magnet powder for resin-bonded magnets according to the present invention comprises powder obtained by disintegrating a sintered ferrite magnetic material, the sintered ferrite magnet powder having a substantially magnetoplumbite-type crystal structure and a basic composition represented by the following general formula:

$$(A_{1-x}R'_x)O.n[(Fe_{1-y}M_y)_2O_3] \text{ by atomic ratio,}$$

wherein A is Sr and/or Ba; R' is at least one selected from the group consisting of rare earth elements including Y, La being indispensable; M is Co or Co and Zn; and x, y and n are numbers meeting the following conditions:

$$0.01 \leqq x \leqq 0.4,$$

$$0.005 \leqq y \leqq 0.04, \text{ and}$$

$$5.0 \leqq n \leqq 6.4.$$

The sintered ferrite magnet powder preferably contains $SiO_2$ and CaO in amounts of 0.05–0.55% by weight and 0.35–1% by weight, respectively, per 100% by weight of the sintered ferrite magnet powder, because such a ferrite magnet powder can provide a sintered body having a dense structure, which shows good magnetizability and/or heat resistance.

The sintered ferrite magnet powder preferably has an average particle size of 2–300 $\mu$m, because such a ferrite magnet powder is suitable for molding in a magnetic field.

The compound for resin-bonded magnets according to the present invention is composed substantially of:

(a) an R—T—N-based magnet powder having a basic composition of $R_\alpha T_{100-\alpha-\beta}N_\beta$, wherein R is at least one selected from the group consisting of rare earth elements including Y; T is Fe or Fe and Co; and α and β satisfy $5 \leqq \alpha \leqq 20$ and $5 \leqq \beta \leqq 30$ by atomic %, (b) a ferrite magnetic powder for resin-bonded magnets comprising powder obtained by disintegrating a sintered ferrite magnetic material, said sintered ferrite magnetic powder having a substantially magnetoplumbite-type crystal structure and a basic composition represented by the following general formula:

$$(A_{1-x}R'_x)O.n[(Fe_{1-y}M_y)_2O_3] \text{ by atomic ratio,}$$

wherein A is Sr and/or Ba; R' is at least one selected from the group consisting of rare earth elements including Y, La being indispensable; M is Co or Co and Zn; and x, y and n are numbers meeting the following conditions:

$$0.01 \leqq x \leqq 0.4,$$

$$0.005 \leqq y \leqq 0.04, \text{ and}$$

$$5.0 \leqq n \leqq 6.4.$$

(c) a binder.

By mixing and kneading the R—T—N-based magnet powder having an average particle size of 1–10 μm, the ferrite magnet powder having an average particle size of 0.9–2 μm (first ferrite magnet powder) and a binder at appropriate proportions, it is possible to obtain a compound capable of providing a resin-bonded magnet with good magnetizability and/or heat resistance.

By compounding and kneading, at appropriate proportions, the R—T—N-based magnet powder having an average particle size of 110 μm, the ferrite magnetic anisotropic, granulated powder (second ferrite magnet powder) and a binder, it is possible to obtain a compound capable of providing a resin-bonded magnet with good magnetizability and/or heat resistance and small unevenness in a surface magnetic flux density.

By mixing and kneading the R—T—N-based magnet powder having an average particle size of 1–10 μm, the ferrite magnet powder which is powder formed from an anisotropic, sintered ferrite magnet body (third ferrite magnet powder) and a binder at appropriate proportions, it is possible to obtain a compound capable of providing a resin-bonded magnet with good magnetizability and/or heat resistance and small unevenness in a surface magnetic flux density.

The resin-bonded magnet according to the present invention is composed substantially of:

(a) an R—T—N-based magnet powder having a basic composition of $R_\alpha T_{100-\alpha-\beta} N_\beta$, wherein R is at least one selected from the group consisting of rare earth elements including Y; T is Fe or Fe and Co; and α and β satisfy $5 \leqq \alpha \leqq 20$ and $5 \leqq \beta \leqq 30$, respectively, by atomic %, (b) a ferrite magnetic powder for resin-bonded magnets comprising powder obtained by disintegrating a sintered ferrite magnetic material, said sintered ferrite magnetic powder having a substantially magnetoplumbite-type crystal structure and a basic composition represented by the following general formula:

$$(A_{1-x}R'_x)O.n[(Fe_{1-y}M_y)_2O_3] \text{ by atomic ratio,}$$

wherein A is Sr and/or Ba; R' is at least one selected from the group consisting of rare earth elements including Y, La being indispensable; M is Co or Co and Zn; and x, y and n are numbers meeting the following conditions:

$$0.01 \leqq x \leqq 0.4,$$

$$0.005 \leqq y \leqq 0.04, \text{ and}$$

$$5.0 \leqq n \leqq 6.4.$$

(c) a binder.

By compounding and kneading, at appropriate proportions, the R—T—N-based magnet powder having an average particle size of 1–10 μm, the ferrite magnet powder having an average particle size of 0.9–2 μm (first ferrite magnet powder) and a binder, and molding the resultant compound in a magnetic field, it is possible to obtain a resin-bonded magnet having good magnetizability and/or heat resistance.

By compounding and kneading, at appropriate proportions, the R—T—N-based magnet powder having an average particle size of 1–10 μm, the ferrite magnet powder which is an anisotropic, granulated powder (second ferrite magnet powder) and a binder, and molding the resultant compound in a magnetic field, it is possible to obtain a resin-bonded magnet with good magnetizability and/or heat resistance and small unevenness in a surface magnetic flux density.

By compounding and kneading, at appropriate proportions, the R—T—N-based magnet powder having an average particle size of 1–10 μm, the anisotropic, sintered ferrite magnet powder formed by pulverizing an anisotropic, sintered ferrite magnet body (third ferrite magnet powder) and a binder, and molding the resultant compound in a magnetic field, it is possible to obtain a resin-bonded magnet with good magnetizability and/or heat resistance and small unevenness in a surface magnetic flux density.

From the aspect of practicality, the resin-bonded magnet of the present invention preferably has a ring shape, a cylindrical shape or an arc-segment shape, and is particularly useful when provided with radial or polar anisotropy.

The rotor according to the present invention is constituted by a resin-bonded magnet composed substantially of:

(a) an R—T—N-based magnet powder having a basic composition of $R_\alpha T_{100-\alpha-\beta} N_\beta$, wherein R is at least one selected from the group consisting of rare earth elements including Y; T is Fe or Fe and Co; and α and β satisfy $5 \leqq \alpha \leqq 20$ and $5 \leqq \beta \leqq 30$, respectively, by atomic %, (b) a ferrite magnetic powder for resin-bonded magnets comprising powder obtained by disintegrating a sintered ferrite magnetic material, said sintered ferrite magnetic powder having a substantially magnetoplumbite-type crystal structure and a basic composition represented by the following general formula:

$$(A_{1-x}R'_x)O.n[(Fe_{1-y}M_y)_2O_3] \text{ by atomic ratio,}$$

wherein A is Sr and/or Ba; R' is at least one selected from the group consisting of rare earth elements including Y, La being indispensable; M is Co or Co and Zn; and x, y and n are numbers meeting the following conditions:

$0.01 \leqq x \leqq 0.4$, $0.005 \leqq y \leqq 0.04$, and $5.0 \leqq n \leqq 6.4$.

(c) a binder.

The rotor of the present invention comprising the above resin-bonded magnet as a field magnet has improved heat resistance and higher efficiency owing to good magnetizability of the resin-bonded magnet as compared with rotors comprising conventional resin-bonded rare earth magnets.

The magnet roll according to the present invention is constituted by a resin-bonded magnet composed substantially of:

(a) an R—T—N-based magnet powder having a basic composition of $R_{\alpha}T_{100-\alpha-\beta}N_{\beta}$, wherein R is at least one selected from the group consisting of rare earth elements including Y; T is Fe or Fe and Co; and $\alpha$ and $\beta$ satisfy $5 \leqq \alpha \leqq 20$ and $5 \leqq \beta \leqq 30$, respectively, by atomic %, (b) a ferrite magnetic powder for resin-bonded magnets comprising powder obtained by disintegrating a sintered ferrite magnetic material, said sintered ferrite magnetic powder having a substantially magnetoplumbite-type crystal structure and a basic composition represented by the following general formula:

$(A_{1-x}R'_x)O.n[(Fe_{1-y}M_y)_2O_3]$ by atomic ratio, wherein A is Sr and/or Ba; R' is at least one selected from the group consisting of rare earth elements including Y, La being indispensable; M is Co or Co and Zn; and x, y and n are numbers meeting the following conditions:

$0.01 \leqq x \leqq 0.4$, $0.005 \leqq y \leqq 0.04$, and $5.0 \leqq n \leqq 6.4$.

(c) a binder.

The magnet roll of the present invention comprising the above resin-bonded magnets at least at developing magnetic poles has a higher surface magnetic flux density owing to good magnetizability of the above resin-bonded magnet, thereby being able to produce very finer image, as compared with magnet rolls comprising conventional resin-bonded rare earth magnets.

BRIEF DESCRIPTION OF THE DRAWINGS

FIG. 8(*b*) is a graph showing the surface magnetic flux density distribution of the long, ring-shaped, resin-bonded, radial magnet produced by using Compound A in Example 9;

FIG. 12(*b*) is a cross-sectional view showing the details of the orienting die of the extruder of FIG. 12(*a*).

THE BEST MODE FOR CONDUCTING THE INVENTION

1 Ferrite Magnet Powder

Figure 1:
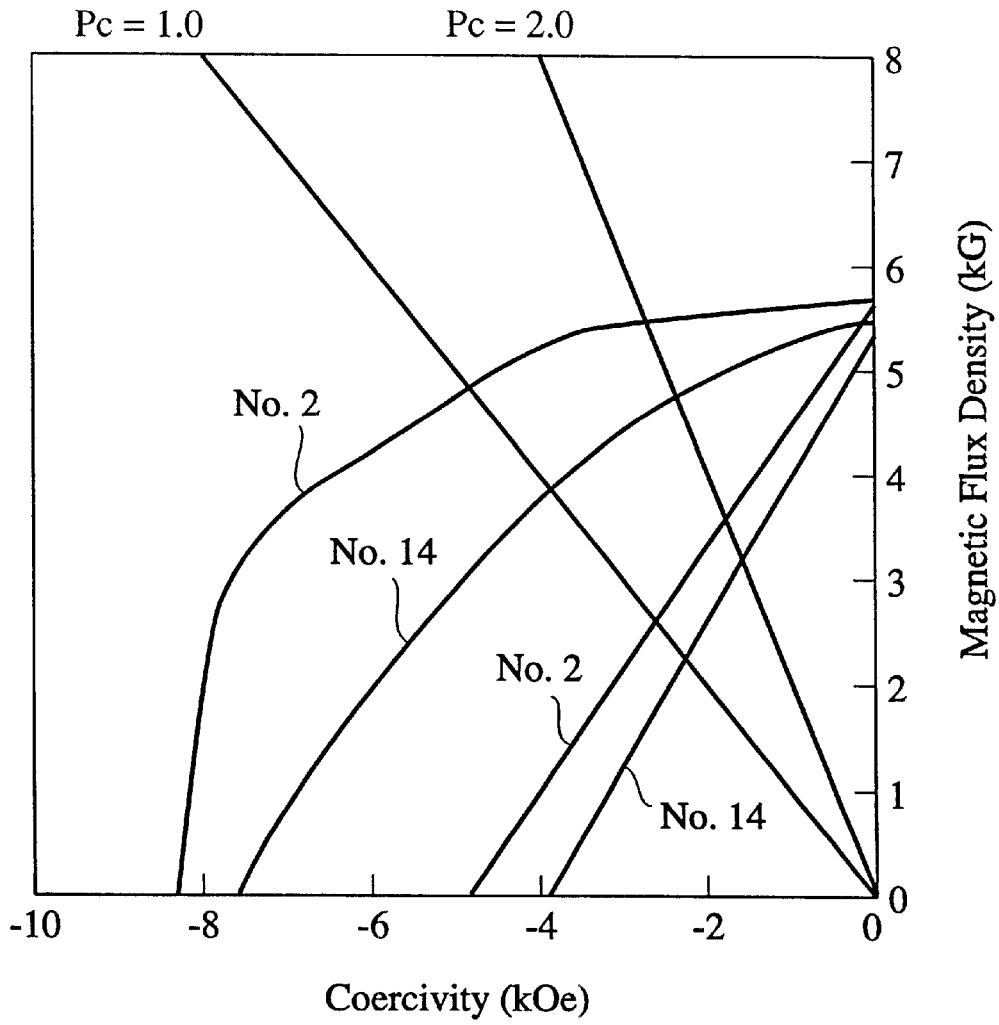
FIG. 1 is a graph showing the demagnetization curves of Sample Nos. 2 and 14.

Usable as the ferrite magnet powder added to compounds for resin-bonded magnets according to the present invention are the following first to third ferrite magnet powders.

(1) First Ferrite Magnet Powder (a) Composition

The first ferrite magnet powder has a substantially magnetoplumbite-type crystal structure and a basic composition represented by the following general formula:

$(A_{1-x}R'_x)O.n[(Fe_{1-y}M_y)_2O_3]$ by atomic ratio, wherein A is Sr and/or Ba; R' is at least one selected from the group consisting of rare earth elements including Y, La being indispensable; M is Co or Co and Zn; and x, y and n are numbers meeting the following conditions:

$0.01 \leqq x0.4$, $0.005 \leqq y \leqq 0.04$, and $5.0 \leqq n \leqq 6.4$.

R' is at least one element selected from the group consisting of rare earth elements including Y and contains La indispensably. Particularly when R' is at least one element selected from the group consisting of La, Nd, Pr and Ce and contains La indispensably, a ferrite magnet powder of high practicality can be obtained. Preferably usable as a starting material for R' in commercial production are mixed rare earth element oxides containing La and at least one element selected form the group consisting of Nd, Pr and Ce. In order to obtain a high saturation magnetization, the ratio of La in R' is preferably 50 atomic % or more, more preferably 70 atomic % or more, particularly preferably 99 atomic % or more. La may be used alone as R'.

Co or Co and Zn are selected as M. The selection of Co is preferable to obtain as high coercivity as possible. The selection of Co and Zn is preferable to obtain as high Br and $(BH)_{max}$ as possible. When Co and Zn are selected as M, and when the resulting ferrite magnet powder is used for applications (e.g. rotors) requiring higher heat resistance and magnetizability than those of conventional resin-bonded rare earth magnets, the ratio of Co in 5 M is preferably 50 atomic % or more and less than 100 atomic %, more preferably 70 atomic % or more. When the ratio of Co in M is less than 50 atomic %, the resulting ferrite magnet powder has a strikingly low heat resistance. When Co and Zn are selected as M, and when the resulting ferrite magnet powder is used for applications (e.g. magnet rolls) requiring higher magnetizability than those of conventional resin-bonded rare earth magnets, the ratio of Co in M is preferably 10–50 atomic %, more preferably 20–50 atomic %. When the ratio of Co in M is less than 10 atomic %, there is substantially no effect of adding Co. When the ratio of Co is more than 50 atomic %, the effect of adding Zn is low, resulting in a ferrite magnet powder poor in Br and $(BH)_{max}$.

The value of n (molar ratio) is preferably 5.0–6.4. When n is larger than 6.4, the proportion of undesirable phases (e.g. $\alpha$-$Fe_2O_3$) other than the magnetoplumbite phase increases, resulting in a ferrite magnet powder having strikingly low magnetic properties. Meanwhile, when n is less than 5.0, the resulting ferrite magnet powder is strikingly low in residual magnetic flux density Br.

X is preferably 0.01–0.4, more preferably 0.1–0.3. When x is less than 0.01, there is substantially no effect of adding R'. When x is more than 0.4, there are no advantages over conventional ferrite magnet powders.

Y and x should ideally satisfy the relation of y=x/(2.0 n) for the purpose of charge compensation. However, as long as y is from x/(2.6 n) to x/(1.6 n), the effects of the present invention by charge compensation are not substantially impaired. When the value of y deviates from x/(2.0 n), there is likelihood that $Fe^{2+}$ is contained without causing any problem. On the other hand, when the value of x/ny is more than 2.6 or less than 1.6, the ferrite magnet powder has remarkably decreased magnetic properties. Accordingly, the preferable range of x/ny is between 1.6 and 2.6. The specific value of y is preferably 0.005–0.04, more preferably 0.008–0.03, particularly preferably 0.01–0.02.

(b) Crystal Structure

The first ferrite magnet powder has a substantially magnetoplumbite-type crystal structure. "Having a substantially magnetoplumbite-type crystal structure" refers not only to a state in which a phase exhibiting magnetic properties in the first ferrite magnet powder is a magnetoplumbite phase alone but also to a state in which the main phase of the first ferrite magnet powder is a magnetoplumbite phase.

(c) Average Particle Size

The average particle size of the first ferrite magnet powder is preferably 0.9–2 $\mu$m, more preferably 1.0–1.5 $\mu$m, particularly preferably 1.05–1.3 $\mu$m. When the average particle size is less than 0.9 $\mu$m, the mixability of magnet powder in the compound is strikingly low, resulting in providing the resultant resin-bonded magnet with remarkably low density, Br and $(BH)_{max}$. Meanwhile, when the average particle size is more than 2 $\mu$m, the resin-bonded magnet has strikingly low iHc and $(BH)_{max}$. The average particle size of the first ferrite magnet powder can be measured by an air permeation method using a Fischer Subsieve sizer.

(d) Other Components

With respect to the contents of impurities inevitably contained in the first ferrite magnet powder, the total amount of Si as $SiO_2$ and Ca as CaO, i.e. $(SiO_2+CaO)$, is preferably 0.2% by weight or less; and the total amount of Al as $Al_2O_3$ and Cr as $Cr_2O_3$, i.e. $(Al_2O_3+Cr_2O_3)$, is preferably 0.13% weight or less. The reasons therefor are as follows. While predetermined amounts of $SiO_2$ and CaO are added intently for control of sinterability and higher density in the production of sintered ferrite magnets, $SiO_2$ and CaO both forming a non-magnetic phase are desirably minimized to obtain a high Br and $(BH)_{max}$ in the first ferrite magnet powder which is not sintered. Increases in the amounts of $Al_2O_3$ and $Cr_2O_3$ reduces Br and $(BH)_{max}$. Therefore, the resin-bonded magnet with low Br and $(BH)_{max}$ can be obtained at $(SiO_2+CaO)$ of more than 0.2% by weight or at $(Al_2O_3+Cr_2O_3)$ of more than 0.13% by weight. $(SiO_2+CaO)$ is more preferably 0.15% by weight or less, and $(Al_2O_3+Cr_2O_3)$ is more preferably 0.1% by weight or less. Because the inclusion of impurities from starting materials and contaminants such as Si, Cr and the like from a crusher and/or a pulverizer is unavoidable in commercial production, it is actually difficult to control $(SiO_2+CaO)$ at 0.005% by weight or less and $(Al_2O_3+Cr_2O_3)$ at 0.005% by weight or less.

(e) Production Process

The first ferrite magnet powder can be produced, for example, by a solid-state reaction method, specifically by the steps of mixing starting materials→calcining for ferritization (solid-state reaction)→pulverization→heat treatment→disintegration. The purity of the iron oxide used in the ferritization (solid-state reaction) is important, and the total amount of Si as $SiO_2$ and Ca as CaO is preferably 0.06% by weight or less, more preferably 0.05% by weight or less, particularly preferably 0.04% by weight or less. Also, the total amount of Al as $Al_2O_3$ and Cr as $Cr_2O_3$ is preferably 0.1% by weight or less, more preferably 0.09% by weight or less, particularly preferably 0.08% by weight or less.

Therefore, it is economical and preferable to use, as a high-purity iron oxide, recycled iron oxide obtained by spray-roasting a waste liquid generated by washing steel with hydrochloric acid. This recycled iron oxide has a lower impurity content than (1) iron oxide obtained by refining iron ore through the steps of iron ore→fine pulverization→classification→magnetic separation, or (2) iron oxide formed from iron sulfate obtained by treating mill scales or scraps.

The first ferrite magnet powder is preferably adjusted to have a target basic composition at the step of calcination. That is, when compounds of R' and M elements are added at the mixing step of the production process, they are subjected to two steps of heat treatment at high temperatures (calcination and heat treatment) to obtain a more homogeneous ferrite composition by promoting their diffusion into solid and to form a more homogeneous ferrite composition. A target basic composition may also be obtained by forming a calcined ferrite powder having a basic composition represented by A'□□$Fe_2O_3$, wherein A' is Sr and/or Ba, and n is 5.0–6.4, and then adding the compounds of R' and M elements at the time of pulverization or before heat treatment and mixing them.

The conditions for mixing, calcination and pulverization may be the same as in the production of sintered ferrite magnets. For example, after wet mixing, a ferritization reaction is conducted by keeping the resultant mixture at 1,150–1,300° C. for 1–5 hours in the air. When the temperature is lower than 1,150° C., the ferritization is insufficient. On the other hand, when the temperature is higher than 1,300° C., the resultant calcined body is too hard, resulting in low pulverization efficiency. Pulverization may be conducted by a combination of a known crusher and a known pulverizer. For fine pulverization, a dry or wet attritor, a ball mill, a vibration ball mill, etc. are used. The average particle size of the finely pulverized powder is preferably 0.8–1.9 μm, more preferably 0.9–1.4 μm, particularly preferably 0.95–1.2 μm.

The heat treatment is preferably conducted under the conditions of 750–950° C.×0.5–5 hours. When the conditions are less than 750° C.×0.5 hours, it is difficult to achieve high iHc. When the conditions are more than 950° C.×5 hours, the resultant ferrite magnet powder suffers from extreme aggregation, resulting in very low Br. A tumbling-type or fluidized bed-type heat treatment apparatus is preferably used to prevent powder aggregation during the heat treatment. An average particle size of the heat-treated ferrite magnet powder is by about 0.05–0.1 μm larger than that of the finely pulverized ferrite magnet powder.

(2) Second Ferrite Magnet Powder

The second ferrite magnet powder is a powder obtained by subjecting a ferrite magnet powder to anisotropic granulation. The second ferrite magnet powder (anisotropic, granulated powder) can be produced, for example, by the steps of mixing starting material powders→calcination for ferritization (solid-state reaction)→pulverization→molding in a magnetic field→crushing→heat treatment→disintegration.

High-purity iron oxide is preferably used as a starting material powder as in the production of the first ferrite magnet powder. A calcined body produced by the same ferritization as in the first ferrite magnet powder is finely pulverized to obtain a fine powder having an average particle size of preferably 0.9–1.4 μm, more preferably 0.95–1.35 μm, particularly preferably 1.0–1.3 μm. When the fine powder has an average particle size of less than 0.9 μm, the resultant second ferrite magnet powder has very low Br. When the average particle size is more than 1.4 μm, the resultant second ferrite magnet powder has very low Br and iHc.

The fine powder is subjected to wet or dry molding in a magnetic field to obtain an anisotropic molded product. The wet or dry molding in a magnetic field is preferably conducted at room temperature under a pressure of 0.35–0.45 ton/cm$^2$ in a magnetic filed of 8–15 kOe. The anisotropic molded product has a density of about 2.6–3.2 g/cm$^3$. The molded product is crushed by a jaw crusher, etc. to powder, which is classified by a sieve or wind to control its average particle size and particle size distribution.

The resultant molded product powder is heat-treated under the same conditions as in the production of the first ferrite magnet powder. The heat treatment conditions are preferably 750–950° C.×0.5–5 hours. The ferrite magnet powder after heat treatment is subjected if necessary to a treatment for destroying aggregation (disintegration treatment) to obtain an anisotropic, granulated powder of 2 μm or more in an average particle size having magnetic anisotropy with a substantially aligned easy-magnetization axis.

In the anisotropic, granulated powder, as in the first ferrite magnet powder, the total amount of Si as $SiO_2$ and Ca as CaO, i.e. ($SiO_2$+CaO), is preferably 0.2% by weight or less, more preferably 0.15% by weight or less. Also, the total amount of Al as $Al_2O_3$ and Cr as $Cr_2O_3$, i.e. ($Al_2O_3$+$Cr_2O_3$), is preferably 0.13% by weight or less, more preferably 0.1% by weight or less.

The anisotropic, granulated powder has an average particle size of preferably 2–300 μm, more preferably 3–100 μm. When the average particle size is less than 2 μm, the anisotropic, granulated powder has no advantages over the first ferrite magnet powder. When the average particle size is more than 300 μm, the anisotropic, granulated powder provides a resin-bonded magnet with poor surface properties, making it difficult to use the magnet for applications having small magnetic gaps. Incidentally, the average particle size of the anisotropic, granulated powder can be measured by a laser diffraction-type particle size distribution tester (HEROS RODOS System available from Sympatec Co.).

The second ferrite magnet powder also has a substantially magnetoplumbite-type crystal structure.

(3) Third Ferrite Magnet Powder

The third ferrite magnet powder is a powder of an anisotropic, sintered ferrite magnetic material having the same basic composition as the first ferrite magnet powder and, as a practical example, a powder of the scrap of the first ferrite magnet. The third ferrite magnet powder can be produced, for example, by a process comprising the steps of mixing of starting material powders→calcination for ferritization (solid-state reaction)→pulverization →molding in a magnetic field→sintering→crushing→heat treatment→disintegration. The third ferrite magnet powder can also be produced, for example, by a process comprising the steps of mixing starting material powders→calcination for ferritization (solid-state reaction)→pulverization →molding in a magnetic→field crushing→sintering→disintegration→heat treatment→disintegration. In the latter process, the molded product obtained by molding in a magnetic field is crushed to an average particle size of 300 μm or less, followed by sintering and heat treatment; resulting in low pulverization cost. The iron oxide used as a starting material powder is preferably a high-purity iron oxide as in the first ferrite magnet powder.

In the production of the third ferrite magnet powder, adjustment to a target basic composition is made at either step of the mixing of starting material powders, calcination and pulverization before molding in a magnetic field.

In the mixing, calcination, pulverization, molding in a magnetic field and sintering, the same conditions can be used as in the production of usual sintered ferrite magnets. For example, wet mixing is conducted and then calcination is conducted in the air under the conditions of 1,150–1,300° C.×1–5 hours. Next, coarse pulverization and fine pulverization are conducted in this order to obtain a fine powder having an average particle size of 0.4–0.9 μm as measured by an air permeation method using a Fischer Subsieve sizer. Thereafter, the fine powder is subjected to wet or dry molding in a magnetic field to obtain a molded product. The molding is preferably conducted at room temperature under a pressure of about 0.35–0.45 ton/cm$^2$ while applying a magnetic field of 8–15 kOe. The sintering is preferably conducted in the air under the conditions of 1,180–1,230° C.×1–5 hours. The resultant sintered body is subjected to coarse pulverization and then classification by a sieve or wind to obtain a powder having an average particle size of 2–300 μm.

The powder of a sintered body is preferably heat-treated in the air under the conditions of 750–1,000° C.×0.5–10 hours. The ferrite magnet powder after heat treatment is subjected to a treatment for destroying aggregation (disintegration treatment), if necessary, to obtain the third ferrite magnet powder. The reason why the upper limit of the heat treatment temperature for the third ferrite magnet powder can be set higher than those of the first and second ferrite magnet powders is that the third ferrite magnet powder is less aggregated by heat treatment, thus suffering from less reduction in Br and iHc.

The third ferrite magnet powder has an average particle size of preferably 2–300 μm, more preferably 3–100 μm. When the average particle size is less than 2 μm, the third ferrite magnet powder has no advantages over the first ferrite magnet powder. When the average particle size is more than 300 μm, the third ferrite magnet powder provides a resin-bonded magnet with poor surface properties, making it difficult to use the magnet for applications having small magnetic gaps. The average particle size of the third ferrite magnet powder can be measured by a laser diffraction-type particle size distribution tester (HEROS RODOS System available from Sympatec Co.).

The third ferrite magnet powder is a mass of magnetoplumbite-type crystal grains, in which individual grains are aligned substantially in the same direction consisting of polycrystalline, anisotropic, sintered ferrite magnetic particles. When the cross section structure of the third ferrite magnet powder parallel to the C axis is observed by an electron microscope, etc., the averaged maximum thickness (t) of the magnetoplumbite-type crystal grains in their C-axis directions is preferably 0.4–1.2 μm, more preferably 0.5–1.0 μm, particularly preferably 0.7–0.95 μm to obtain high iHc and $(BH)_{max}$.

The third ferrite magnet powder preferably contains appropriate amounts of $SiO_2$ and CaO to provide a dense sintered structure. $SiO_2$ is added to suppress the growth of crystal grains during sintering, and its content is preferably 0.05–0.55% by weight, more preferably 0.25–0.55% by weight. When the $SiO_2$ content is less than 0.05% by weight, the growth of crystal grains proceeds excessively during sintering, resulting in very low iHc. When the $SiO_2$ content is more than 0.55% by weight, the growth of crystal grains is suppressed excessively, resulting in insufficient improvement in orientation and thus very low Br. CaO is an element for promoting the growth of crystal grains, and its content is preferably 0.35–1% by weight, more preferably 0.35–0.85% by weight. When the CaO content is more than 1% by weight, the growth of crystal grains during sintering proceeds excessively, resulting in very low iHc. When the CaO content is less than 0.35% by weight, the growth of crystal grains is suppressed excessively, resulting in insufficient improvement in orientation and very low Br.

The third ferrite magnet powder also has a substantially magnetoplumbite-type crystal structure.

The ferrite magnet powder used in the present invention may be a mixture of the first to third ferrite magnet powders at desired proportions.

In any of the first to third ferrite magnet powders, a Bi compound is preferably added in the heat treatment in an amount of 0.2–0.6% by weight as $Bi_2O_3$ per 100% by weight of the total amount of ferrite magnet powder+$Bi_2O_3$. In the case of the first and second ferrite magnet powders, a heat treatment is conducted by keeping the resultant mixture in the air at a temperature of 825–950° C., the melting point of $Bi_2O_3$ or higher, for 0.5–5 hours, such that the resultant ferrite magnet powder is free from strain and has high magnetizability and coercivity.

In the case of the third ferrite magnet powder, a heat treatment is conducted by keeping the mixture in the air at a temperature of 825–1,000° C., the melting point of $Bi_2O_3$ or higher, for 0.5–10 hours. When the heat treatment conditions are less than 825° C.×0.5 hours, the liquefaction of $Bi_2O_3$ is difficult, failing to obtain sufficient effect of suppressing aggregation by addition of the Bi compound and thus high iHc. When the heat treatment conditions exceed the above upper limit, Br decreases greatly although iHc increases relatively.

The ferrite particles obtained by heat treatment with the Bi compound tends to have a larger thickness in the C-axis direction and be rounder than those obtained without the Bi compound. Round ferrite particles are preferred for higher dispersibility and filling ratio in a binder and higher magnetic orientation. When the amount of the Bi compound added is less than 0.2% by weight, no effect is obtained. When the amount of the Bi compound added is more than 0.6% by weight, the effect is saturated.

2 Compound

The compound for resin-bonded magnets according to the present invention contains, besides the ferrite magnet powder, an R—T—N-based magnet powder and a binder.

(1) R—T—N-based Magnet Powder (a) Composition

Used as the R—T—N-based magnet powder for practical purposes is preferably an Sm—T—N-based magnet alloy powder (T is Fe or Fe and Co) containing a $Th_2Zn_{17}$-type or $Th_2Ni_{17}$-type crystal phase as a main phase. R may contain at least one element (other than Sm) selected from the group consisting of rare earth elements including Y. In order to obtain a resin-bonded magnet having high iHc, the ratio of Sm in R is preferably 50 atomic % or more, more preferably 90 atomic % or more. R is ideally Sm other than inevitable rare earth elements.

To improve magnetic properties and corrosion resistance, part of Sm and/or Fe is preferably replaced with at least one element selected form the group consisting of Co, Ni, Ti, Cr, Mn, Zn, Cu, Zr, Nb, Mo, Ta, W, Ru, Rh, Hf, Re, Os and Ir. The total amount of the replacing elements is, other than Co, preferably 10 atomic % or less per the total amount of Sm and Fe. When the total amount of the replacing elements is more than 10 atomic %, striking reduction of Br and $(BH)_{max}$ takes place. Because there is small reduction of Br and $(BH)_{max}$ in the case of replacement with Co, the amount of Co substituting for Fe may be in a range of 0.1–70 atomic % per Fe, resulting in increase in a Curie temperature.

The content of R is preferably 5–20 atomic %. When the R content is less than 5 atomic %, the resultant resin-bonded magnet has very low iHc. When the R content is more than 20 atomic %, the resin-bonded magnet has a very low residual magnetic flux density Br.

The content of N is preferably 5–30 atomic %. When the N content is less than 5 atomic % or more than 30 atomic %, the resultant resin-bonded magnet has low magnetic anisotropy and very low iHc and $(BH)_{max}$. It is possible to replace part of N with at least one element selected from the group consisting of C, P, Si, S and Al. The amount of the replacing element is preferably 10 atomic % or less per the N content. When the amount of the replacing element is more than 10 atomic %, the resultant resin-bonded magnet has very low iHc.

Used as the R—T—N-based magnet powder may be a magnet alloy powder containing a $ThMn_{12}$-type crystal phase as a main phase, which has a basic composition represented by $Nd_{5-10}T_{bal}N_{3-13}$ (T is Fe or Fe and Co) by atomic %, and an average particle size of preferably 1–10 μm. When the Nd content is outside 5–10 atomic %, or when the N content is outside 3–13 atomic %, it is difficult to provide the resultant resin-bonded magnet with sufficient magnetic properties.

(b) Average Particle Size

The R—T—N-based magnet powder preferably has an average particle size of 1–10 μm to have good magnetic anisotropy. When the average particle size is less than 1 μm, the R—T—N-based magnet powder undergoes severe oxidative deterioration, resulting in a resin-bonded magnet with largely decreased powder-filing ratio and $(BH)_{max}$. When the average particle size is more than 10 $\mu$m, the resultant resin-bonded magnet usually has decreased magnetic anisotropy and thus low $(BH)_{max}$.

(c) Production Process

Preferably used as the starting material alloy for the R—T—N-based magnet powder is an R—T-based matrix alloy controlled to have a corresponding basic composition by a melting method or an R/D method. The production of an R—T-based matrix alloy powder to be nitrided and the pulverization of the nitrided powder to fine powder are preferably conducted efficiently using a hammer mill, a disc mill, a vibration mill, an attritor, a jet mill, etc. in an inert gas atmosphere. An R—T-based matrix alloy powder obtained by pulverization is nitrided to have high saturation magnetization and magnetic anisotropy.

The nitriding of the R—T-based matrix alloy powder is conducted by keeping it in an atmosphere or flow of nitrogen, a nitrogen/hydrogen mixed gas, an ammonia gas or an ammonia-containing, reducing mixed gas (e.g. ammonia/hydrogen mixed gas, ammonia/nitrogen mixed gas or ammonia/argon mixed gas) at 300–650° C. for 0.1–30 hours. When the heating conditions are less than 300° C.×0.1 hour or more than 650° C.×30 hours, it is difficult to obtain an R—T—N-based magnet powder having a nitrogen content is in an industrially usable range. Though the R—T-based matrix alloy powder contains hydrogen unavoidably before and after nitriding, the final hydrogen content of the R—T—N-based magnet powder is 0.01–10 atomic % by exposure to a hydrogen-containing nitriding gas.

(2) Binder

Practically used as the binder may be thermosetting resins, thermoplastic resins or rubbers. Thermosetting resins are preferred when compression molding is employed. Thermoplastic resins are preferred when extrusion molding or injection molding is employed. Any thermosetting resins, thermoplastic resins and rubbers are suitable when calendar roll molding is employed.

(3) Compounding Ratio

In the compound for resin-bonded magnets according to the present invention, the weight ratio of the R—T—N-based magnet powder to the ferrite magnet powder is preferably 5:95–95:5, more preferably 200:80–80:20. When the weight ratio of the R—T—N-based magnet powder to the ferrite magnet powder is outside the range of 5:95–95:5, it is difficult to obtain a resin-bonded magnet with practically satisfactory magnetizability and/or heat resistance. In order to obtain $(BH)_{max}$ at least equal to those of anisotropic, sintered ferrite magnets, the weight ratio of the magnet powder (R—T—N-based magnet powder+ferrite magnet powder) to the binder is preferably 80/20–98.5/1.5, more preferably 95/5–98/2.

3 Resin-bonded Magnet

The third or second ferrite magnet powder has higher iHc than those of conventional anisotropic Sr and/or Ba ferrite magnet powders and Br at least equal to those of the conventional powders, and the large average particle size can provide the resultant compound with improved flowability (moldability). Therefore, when a long, cylindrical or ring-shaped, anisotropic, resin-bonded magnet having a length of 20–500 mm in the axial direction, for example, a cylindrical or ring-shaped magnet having 2–24 symmetrical or asymmetrical magnetic poles on an inner or outer surface in a circumferential direction, is molded, unevenness in a surface magnetic flux density can be made smaller in the axial direction of the magnetic poles on the inner or outer surface than when compounds containing conventional anisotropic Sr and/or Ba ferrite magnet powders are used. Also, when molding a long, sheet-shaped, resin-bonded magnet having an axial length of 20–500 mm, a thickness of 0.1–5 mm and anisotropy in the thickness direction in a magnetic filed, the unevenness of a surface magnetic flux density can be reduced in the axial direction.

Useful as the resin-bonded magnet having radial or polar anisotropy according to the present invention is a cylindrical, ring-shaped or arc segment-shaped, resin-bonded magnet having an outer diameter of 1–200 mm and an axial length of 0.1–500 mm. It is commercially difficult to produce resin-bonded magnets with radial or polar anisotropy having an outer diameter of less than 1 mm, while resin-bonded magnets having an outer diameter of more than 200 mm find little demand presently. Resin-bonded magnets having an axial length of less than 0.1 mm are fragile and thus difficult to handle, while resin-bonded magnets having an axial length of more than 500 mm find little demand.

When a resin-bonded magnet is molded, for example, by compression molding in a magnetic field, it is preferred to select a binder resin having a low viscosity during a magnetically orienting process to carry out molding at a practical intensity of an orienting magnetic field of 3–10 kOe, preferably 3–6 kOe, more preferably 3–5 kOe to provide a molded product with high orientation and $(BH)_{max}$. This applies also to a case when an anisotropic, resin-bonded magnet is produced by extrusion or injection molding in a magnetic field. It is particularly preferred to dissolve a binder resin in an organic solvent to form a slurry having a low viscosity in which magnet powder is dispersed almost uniformly, and subjecting the slurry to compression molding, extrusion molding or injection molding in a magnetic field at room temperature. It is also effective to conduct compression molding, extrusion molding, calendar roll molding or injection molding in a magnetic field in an inert gas atmosphere usually at 100–350° C. In this case, because the compound pellets in which magnet powder is dispersed are heated to such a predetermined temperature that the R—T—N-based magnet powder contained therein loses coercivity and that the viscosity of the binder resin decreases, molding at a practical intensity of an orienting magnetic field can impart good anisotropy to the resultant resin-bonded magnet.

Figure 9:
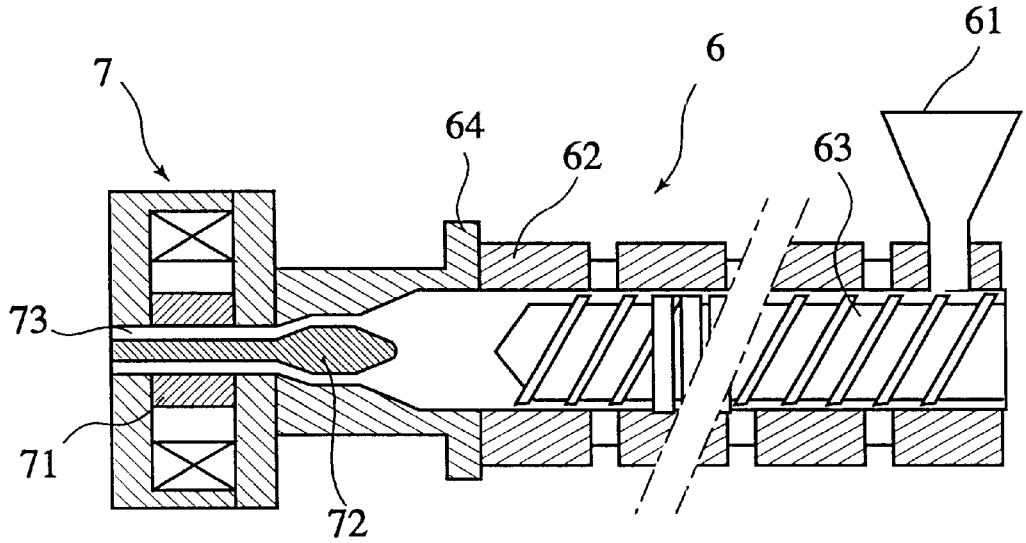
FIG. 9 is a cross-sectional view showing the whole structure of an extruder for producing a radially anisotropic, resin-bonded ring magnet.
Figure 10:
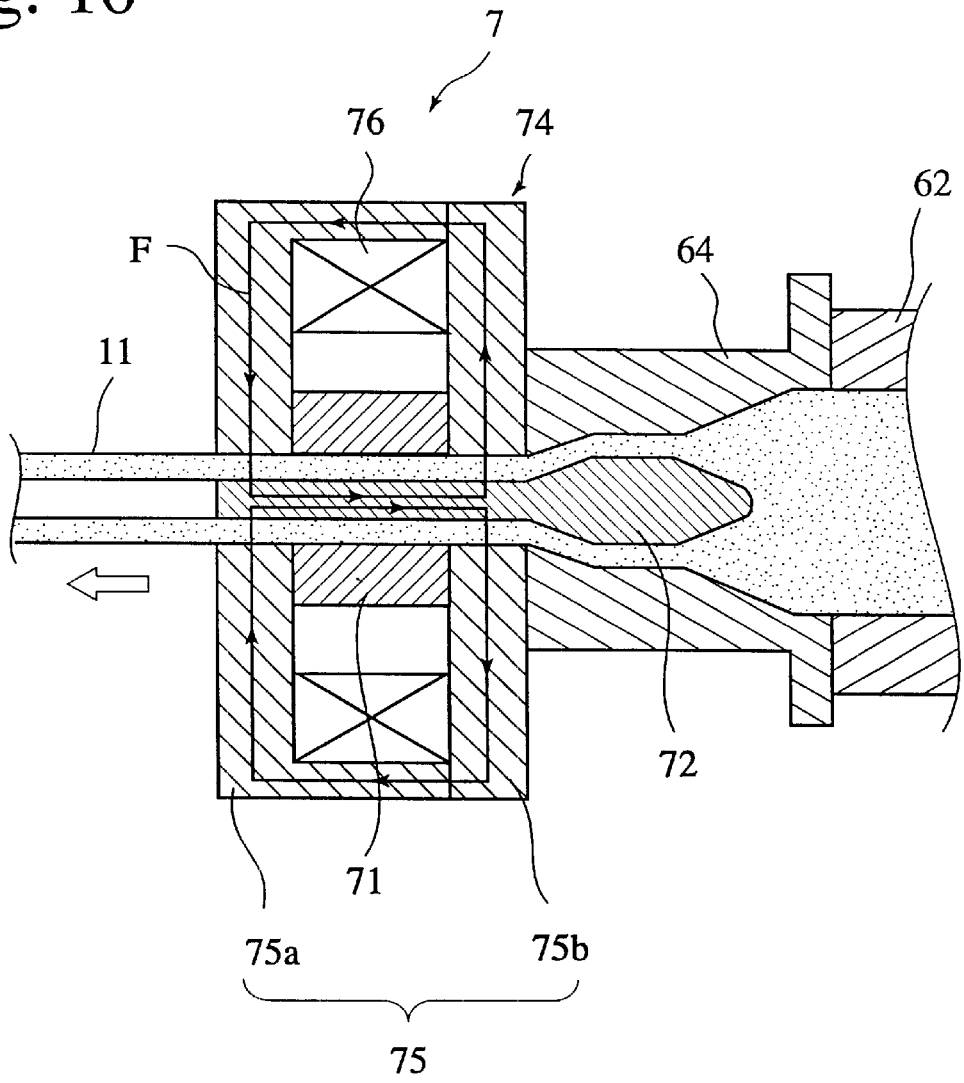
FIG. 10 is a cross-sectional view showing the details of the orienting die of the extruder of FIG. 9.

FIG. 9 is a cross-sectional view showing the whole structure of an extruder for producing radially anisotropic, resin-bonded ring magnet, and FIG. 10 is a cross-sectional view showing the details of an orienting die in the extruder of FIG. 9. As shown in FIG. 9, a double-screw kneading extruder 6 comprises a barrel 62 divided into a plurality of parts, two screws 63 (only one is shown in the figure) disposed therein, an adapter 64 attached to a tip end of the barrel 62, and an orienting die 7 attached to an exit of the adapter 64. Further, the double-screw kneading extruder 6 has a hopper 61 at an upstream end thereof. The die 7 of the molding apparatus comprises a ring-shaped spacer 71 and a mandrel 72 both defining a cylindrical molding space 73, and a magnetic field-generating member 74 disposed around the ring-shaped spacer 71.

With the double-screw kneading extruder 6 using a later-described nylon 12-based compound, for example, a radially anisotropic, resin-bonded magnet can be produced as follows: A compound introduced into the barrel 62 through the hopper 61 is subjected to shear stress by the rotation of a pair of screws 63, and conveyed to the orienting die 7 while being heated at a temperature of 230–280° C. The heated compound passes through a molding space reduced to a predetermined cross section in the orienting die 7 while being exposed to a magnetic field. The intensity of a magnetic field applied practically is preferably 3–6 kOe. When molded in a radially anisotropic magnetic field having such a level of intensity, a radially anisotropic, resin-bonded ring magnet having practically satisfactory magnetic properties can be obtained. When the intensity of a magnetic field applied is less than 3 kOe, it is difficult to obtain useful magnetic properties. When a polar-anisotropic magnetic field is applied, the radial orienting die 7 shown in FIGS. 9 and 10 is replaced with a die (not shown) capable of forming a polar-anisotropic magnetic field.

The resultant resin-bonded magnet having radial or polar anisotropy has so excellent magnetic properties, magnetizability, heat resistance and uniformity in a surface magnetic flux density distribution that it is suitably used as rotor magnets or magnet rolls.

The present invention will be described in more detail by the following Examples without intention of restricting the present invention thereto.

REFERENCE EXAMPLE 1

Production of R—T—N-based Magnet Powder

An R—T—N-based, coarse magnet powder of 15 μm in average particle size comprising a $Th_2Zn_{17}$-type crystal phase as a phase exhibiting magnetic properties and having a basic composition of $Smg_{9.1}Fe_{76.8}Mn_{0.5}N_{13.6}$ by atomic % was finely pulverized to an average particle size of 4.0 μm by a jet mill using Ar as a pulverization medium. Then, fine pulverization was conducted by a wet ball mill using hexane, to obtain a fine powder having an average particle size of 2.3 μm and a sharp particle size distribution of 0.5–30 μm as measured by a HEROS RODOS system. The reason for combined use of a jet mill and a wet ball mill is: (1) fine pulverization by a jet mill provides a fine powder having a sharp particle size distribution, though the jet mill is poor in pulverization efficiency and thus unsuitable for commercial production of fine powder having an average particle size of less than 4 μm; and (2) fine pulverization by a wet ball mill alone provides fine powder containing a large amount of very fine sub-micron particles of less than 0.5 μm and accordingly having a broad particle size distribution, and a resin-bonded magnet produced therefrom has very low $(BH)_{max}$, etc.

Production of First Ferrite Magnet Powder

High-purity, recycled iron oxide powder ($\alpha$-$Fe_2O_3$, purity: 99.4%, Cl: 0.056% by weight, $SO_4$: 0.02% by weight, MnO: 0.290% by weight, $SiO_2$: 0.010% by weight, CaO: 0.018% by weight, $Cr_2O_3$: 0.027% by weight, and $Al_2O_3$: 0.060% by weight), $SrCO_3$ powder (containing Ba and Ca as impurities), $La_2O_3$ powder and Co oxide powder were compounded such that the resultant compound had, after calcination, a basic composition of $(Sr_{1-x}La_x)O.n[Fe_{1-y}CO_y)_2O_3]$(n=5.85, x=0.15, y=x/2n). The resultant compound was wet-mixed and calcined at 1,200° C. for 2 hours in the air. The calcined powder was dry-pulverized by a roller mill to obtain a coarsely pulverized powder.

700 g of the above coarse powder was charged into a ball mill pot (capacity: 10 liters, made of SUJ3) together with 10 kg of steel balls (diameter: 6 mm, made of SUJ3) as a pulverization medium, and ethyl alcohol (initially added: 50 cc) as a pulverization aid. After sealing the pot tightly, dry fine pulverization was conducted by ball milling at a peripheral speed of 0.7 m/sec to obtain a fine ferrite powder having an average particle size of 1.05 μm as measured by an air permeation method using a Fischer Subsieve sizer. After about 0.2 % by weight of $Bi_2O_3$ was added to the powder, the resultant mixture was placed in a heat-resistant vessel, which was set in a furnace having the air atmosphere. A heat treatment (annealing for removal of strain) was carried out at 830±2° C. for 3 hours, and the heating furnace was then cooled to room temperature. The heat-treated powder was immersed in water to break the aggregation of the ferrite magnet powder, which was caused by the heat treatment. The resultant powder was heated to 100° C. to remove water and then cooled to room temperature. The powder was then classified by a 150-mesh sieve to obtain, as a first ferrite magnet powder, a ferrite magnet powder for resin-bonded magnets having an average particle size of 1.10 μm. This ferrite magnet powder had an (Si+Ca) content of 0.133% by weight as $SiO_2$+CaO and an (Al+Cr) content of 0.082% by weight as $Al_2O_3$+$Cr_2O_3$.

Production of Anisotropic, Resin-bonded Magnet

The above R—T—N-based magnet powder and the first ferrite magnet powder were compounded at a weight ratio of 80/20 and then mixed in a mixer. 100 parts by weight of the resultant mixed magnet powder was charged into a stirring apparatus together with 2.8 parts by weight of a liquid epoxy resin, 0.7 part by weight of a curing agent (DDS, i.e. diaminodiphenylsulfone) and 2.8 parts by weight of methyl ethyl ketone (boiling point: 79.5° C.) as an organic solvent. Stirring was conducted at 20 rpm for 20 minutes to obtain a slurry. While applying a parallel magnetic field of 6 kOe at room temperature, the slurry was wet-compression-molded at a pressure of 8 tons/$cm^2$. The resultant molded product was heated to remove the solvent at 85° C. for 1 hour and then cured at 170° C. for 2 hours to obtain an anisotropic, resin-bonded magnet as Sample No. 1 shown in Table 1.

Anisotropic, resin-bonded magnets of Sample Nos. 2 and 3 were obtained in the same manner as in the above mentioned Sample No. 1 except that the R—T—N-based magnet powder and the first ferrite magnet powder were compounded at weight ratios of 50/50 and 20/80, respectively.

For practical assembling, each of the resin-bonded magnet (Nos. 1 to 3) was subjected to AC demagnetization, and then magnetized in a magnetic field of 10 kOe at 20° C. using a B-H tracer to draw a demagnetization curve to determine its iHc and $(BH)_{max}$. The demagnetization curve of Sample No. 2 is shown in FIG. 1.

Figure 2:
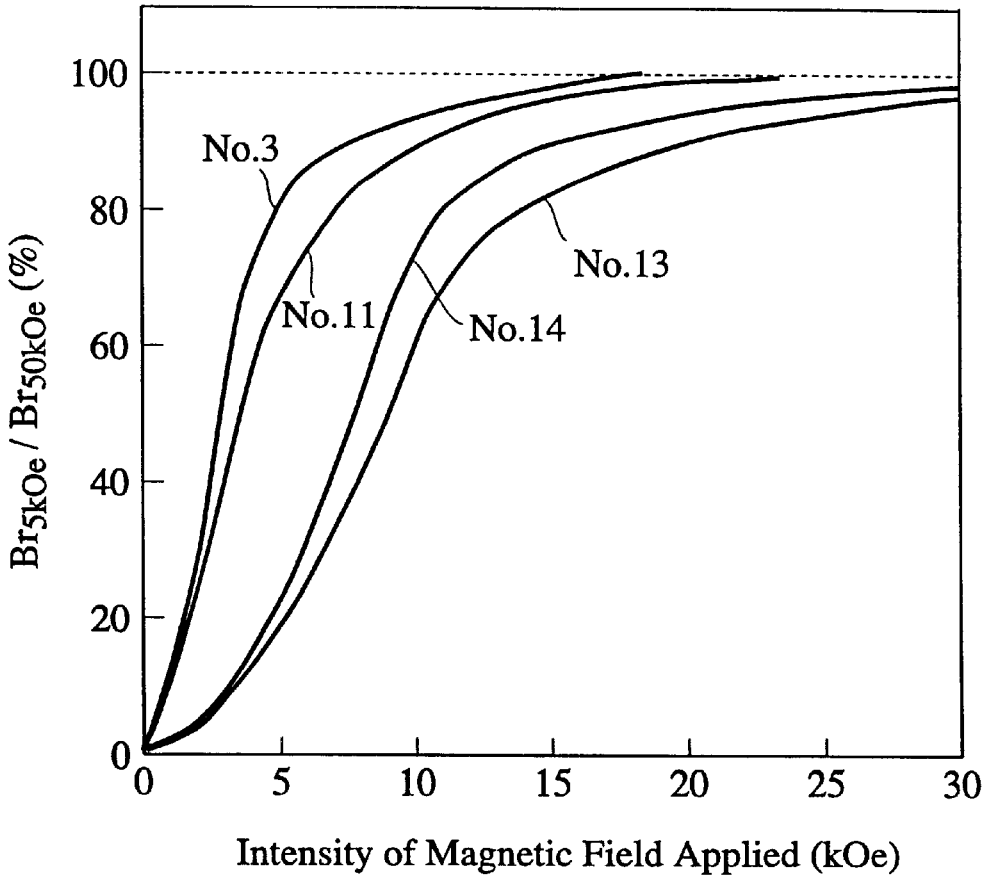
FIG. 2 is a graph showing the relations between magnetizability and the intensity of a magnetic field applied in Sample Nos. 3, 11, 13 and 14.

Each of the resin-bonded magnets (Nos. 1 to 3) was examined for magnetizability. Magnetizability is expressed by the following formula:

$$\text{Magnetizability}=(Br_{5kOe}/Br_{50kOe})\times 100\ (\%)$$

wherein $Br_{5kOe}$ is a Br value achieved under the conditions of 20° C. and a magnetizing field intensity of 5 kOe, and $Br_{5kOe}$ is a Br value achieved under the conditions of 20° C. and a magnetizing field intensity of 50 kOe. The results of the magnetizability are shown in Table 1. The dependency of the magnetizability of the anisotropic, resin-bonded magnet (Sample No. 3) on a magnetic field intensity is shown in FIG. 2.

Each of the resin-bonded magnets (Sample Nos. 1 to 3) was worked to attain Pc=2, that is, thickness in magnetization direction / diameter=0.7, and then magnetized at 30 kOe at 20° C. to measure a total magnetic flux (Φ). Each of the worked, anisotropic, resin-bonded magnets (Sample Nos. 1 to 3) was kept for 1 hour at temperatures of 40° C., 45° C., 50° C., 55° C., 60° C., 65° C., 70° C., 75° C., 80° C., 85° C., 90° C., 95° C., 100° C., 105° C., 110° C., 115° C., 125° C., 130° C., 135° C. and 140° C., and then cooled to room temperature. Each Sample after cooling was measured with respect to total magnetic flux (Φ'). The change of total magnetic flux, (irreversible loss of flux) is expressed by the following formula:

$$\text{Irreversible loss of flux}=[(\Phi-\Phi')/()]\times 100\ (\%).$$

A temperature at which the irreversible loss of flux reaches 5% is defined as a heat-resistant temperature. Each of the anisotropic, resin-bonded magnets (Sample Nos. 1 to 3) was examined with respect to a heat-resistant temperature. The results are shown in Table 1.

COMPARATIVE EXAMPLE 1

A slurry was produced, and an anisotropic, resin-bonded magnet was produced therefrom and measured with respect to properties in the same manner as in Reference Example 1 except for using only the R—T—N-based magnet powder of Reference Example 1 as a magnet powder. The results are shown as Sample No. 11 in Table 1. The dependency of the magnetizability of Sample No. 11 on a magnetic field intensity is shown in FIG. 2.

COMPARATIVE EXAMPLE 2

A slurry was produced, and an anisotropic, resin-bonded magnet was produced therefrom and measured with respect to properties in the same manner as in Reference Example 1 except for using only the first ferrite magnet powder of Reference Example 1 as a magnet powder. The results are shown as Sample No. 12 in Table 1.

COMPARATIVE EXAMPLE 3

A slurry was produced, and an anisotropic, resin-bonded magnet was produced therefrom and measured with respect to properties in the same manner as in Reference Example 1 except for using only MQA-T produced by MQI Co. (anisotropic magnet powder containing a main phase of $Nd_2Fe_{14}B$), produced by hydrogenation-decomposition and dehydrogenation-recombination (HDDR)] as a magnet powder. The results are shown as Sample No. 13 in Table 1. The dependency of the magnetizability of Sample No. 13 on a magnetic field intensity is shown in FIG. 2.

COMPARATIVE EXAMPLE 4

An isotropic, resin-bonded magnet was produced and measured with respect to properties in the same manner as in Reference Example 1 except for producing a slurry with only MQP-B produced by MQI Co. (isotropic magnet powder containing a main phase of $Nd_2Fe_{14}B$) as a magnet powder and compression-molding the slurry without applying a magnetic field. The results are shown as Sample No. 14 in Table 1. A demagnetization curve of Sample No. 14 is shown in FIG. 1, and the dependency of the magnetizability of Sample No. 14 on a magnetic field intensity is shown in FIG. 2.

COMPARATIVE EXAMPLE 5

A Sr ferrite magnet powder for resin-bonded magnets having an average particle size of 1.10 μm was obtained in the same manner as in Reference Example 1 except that the powder had a basic composition of $SrO.5.85Fe_2O_3$. This Sr ferrite magnet powder and the R—T—N-based magnet powder of Reference Example 1 were compounded at weight ratios of 20/80, 50/50 and 80/20, respectively. Thereafter, by the same method as in Reference Example 1, a slurry was produced, and anisotropic, resin-bonded magnet was produced therefrom and measured with respect to properties. The results are shown as Sample Nos. 15 to 17 in Table 1.

COMPARATIVE EXAMPLE 6

A ferrite magnet powder having an (Si+Ca) content of 0.25% by weight as ($SiO_2$+CaO) and an (Al+Cr) content of 0.18% by weight as ($Al_2O_3$+$Cr_2O_3$) was produced in the same manner as in Reference Example 1 except for adding required amounts of $SiO_2$ powder and $Cr_2O_3$ powder at the time of wet fine pulverization by a ball mill. This ferrite magnet powder is referred to as "ferrite A." This ferrite magnet powder and the R—T—N-based magnet powder of Reference Example 1 were mixed at different ratios to prepare three types of slurries in the same manner as in Reference Example 1. Each anisotropic, resin-bonded magnet was produced from each slurry and measured with respect to properties in the same manner as in Reference Example 1. The results are shown as Sample Nos. 18 to 20 in Table 1.

REFERENCE EXAMPLE 2

A first ferrite magnet powder for resin-bonded magnets having an average particle size of 0.94 μm and containing (Si+Ca) in an amount of 0.178% by weight as $SiO_2$+CaO and (Al+Cr) in an amount of 0.083% by weight as $Al_2O_3$+$Cr_2O_3$ was produced in the same manner as in Reference Example 1 except for changing the conditions of dry fine pulverization by ball mill for first ferrite magnet powder. This first ferrite magnet powder and the R—T—N-based magnet powder of Example 1 were compounded at a weight ratio of 20/80. A slurry was produced, and an anisotropic, resin-bonded magnet was produced therefrom and measured with respect to properties in the same manner as in Reference Example 1. The results are shown as Sample No. 21 in Table 1.

REFERENCE EXAMPLE 3

A first ferrite magnet powder for resin-bonded magnets having an average particle size of 1.98 μm and containing (Si+Ca) in an amount of 0.041% by weight as $SiO_2$+CaO and (Al+Cr) in an amount of 0.076% by weight as $Al_2O_3$+$Cr_2O_3$ was produced in the same manner as in Reference Example 1 except for changing the conditions of dry fine pulverization by ball mill for first ferrite magnet powder. This first ferrite magnet powder and the R—T—N-based magnet powder of Reference Example 1 were compounded at a weight ratio of 20/80. A slurry was then produced, and an anisotropic, resin-bonded magnet was produced therefrom and measured with respect to properties in the same manner as in Reference Example 1. The results are shown as Sample No. 22 in Table 1.

REFERENCE EXAMPLE 4

The same iron oxide powder, $SrCO_3$ powder, $La_2O_3$ powder and Co oxide powder as in Reference Example 1 and ZnO powder having a purity of 99.0% or more were compounded to achieve an after-calcination basic composition (described below), and then wet-mixed. The resultant mixture was calcined in the air at 1,300° C. for 2 hours, and crushed by a jaw crusher and then dry-coarse-pulverized by a roller mill to obtain a coarse powder. Thereafter, by the same procedures as in Reference Example 1 the coarse powder was subjected to dry fine pulverization by a ball mill, a heat treatment, immersion in water, heat-drying and classification in this order to obtain a first ferrite magnet powder of 1.05 $\mu$m in average particle size having a basic composition represented by $(Sr_{0.77}La_{0.23})O.5.72[(Fe_{0.983}Co_{0.0085}Zn_{0.0085})_2O_3]$. This first ferrite magnet powder had an (Si+Ca) content of 0.128% by weight as ($SiO_2$+CaO) and an (Al+Cr) content of 0.079% by weight as ($Al_2O_3$+$Cr_2O_3$).

This first ferrite magnet powder and the R—T—N-based magnet powder of Reference Example 1 were compounded at a weight ratio of 50/50. A slurry was then produced, and an anisotropic, resin-bonded magnet was produced therefrom and measured with respect to properties in the same manner as in Reference Example 1. The results are shown as Sample No. 23 in Table 1.

heat-resistant temperature than Sample No. 2, though the former had higher $(BH)_{max}$ than the latter.

Sample No. 11 of Comparative Example 1 had magnetizability of 67% and a heat-resistant temperature of 60° C., inferior to those of Examples 1 to 4. Sample No. 12 of Comparative Example 2 using only a first ferrite magnet powder without R—T—N-based magnet powder had low $(BH)_{max}$.

Each of the anisotropic, resin-bonded magnet of Sample No. 13 of Comparative Example 3 using a magnet powder containing an $Nd_2Fe_{14}B$ main phase and the isotropic resin-bonded magnet of Sample No. 14 of Comparative Example 4 had poor magnetizability. Sample Nos. 1 and 2 had higher $(BH)_{max}$ than that of Sample No. 14.

In Comparative Example 5, Sample No. 15 using a high compounding ratio of the R—T—N-based magnet powder gave a higher $(BH)_{max}$ than Sample No. 14, while Sample Nos. 15 to 17 had poorer $(BH)_{max}$, iHc and heat-resistant temperature than those of Sample Nos. 1 to 3 and 23 with the same mixing ratios.

TABLE 1

| | Sample No. | Magnetic Powders Compounded (wt. %) | | $(BH)_{max}$ (MGOe) | iHc (kOe) | Magnetizability (%) | Heat-Resistant Temp. (° C.) |
|---|---|---|---|---|---|---|---|
| Ref. Ex. 1 | 1 | R-T-N (80) | First Ferrite (20) | 13.5 | 8.7 | 74 | 85 |
| | 2 | R-T-N (50) | First Ferrite (50) | 8.3 | 8.4 | 77 | 105 |
| | 3 | R-T-N (20) | First Ferrite (80) | 4.3 | 7.9 | 82 | 120 |
| Com. Ex. 1 | 11 | R-T-N (100) | — | 17.6 | 8.8 | 67 | 60 |
| Com. Ex. 2 | 12 | — | First Ferrite (100) | 2.4 | 5.1 | 93 | <140* |
| Com. Ex. 3 | 13 | MQA-T (100) | — | 10.2 | 7.0 | 17 | 70 |
| Com. Ex. 4 | 14 | MQP-B (100) | — | 7.6 | 7.3 | 21 | 95 |
| Com. Ex. 5 | 15 | R-T-N (80) | Sr Ferrite (20) | 12.1 | 7.5 | 74 | 70 |
| | 16 | R-T-N (50) | Sr Ferrite (50) | 7.2 | 5.8 | 77 | 90 |
| | 17 | R-T-N (20) | Sr Ferrite (80) | 3.3 | 4.3 | 82 | 110 |
| Com. Ex. 6 | 18 | R-T-N (80) | Ferrite A (20) | 12.2 | 8.6 | 65 | 85 |
| | 19 | R-T-N (50) | Ferrite A (50) | 7.5 | 8.2 | 67 | 105 |
| | 20 | R-T-N (20) | Ferrite A (80) | 3.7 | 7.6 | 69 | 120 |
| Ref. Ex. 2 | 21 | R-T-N (80) | First Ferrite (20) | 12.5 | 9.2 | 71 | 90 |
| Ref. Ex. 3 | 22 | R-T-N (80) | First Ferrite (20) | 12.6 | 8.1 | 77 | 80 |
| Ref. Ex. 4 | 23 | R-T-N (50) | First Ferrite **(50) | 8.6 | 6.0 | 78 | 95 |

As is clear from Table 1, Sample Nos. 1 to 3 of Example 1 showed improved magnetic properties, that is, $(BH)_{max}$ of 4.3 MGOe or more, magnetizability of more than 70% and heat-resistant temperatures of 85° C. or more. Sample No. 21 of Reference Example 2 using a first ferrite magnet powder of 0.94 $\mu$m in average particle size and Sample No. 22 of Reference Example 3 using a first ferrite magnet powder of 1.98 $\mu$m in average particle size also showed high $(BH)_{max}$, magnetizability of more than 70% and heat-resistant temperatures of 80° C. or more.

Sample No. 23 of Reference Example 4 using a first ferrite magnet powder containing Zn showed lower iHc and Because Sample Nos. 18 to 20 of Comparative Example 6 used a ferrite magnet powder having an (Si+Ca) content of more than 0.2% by weight as ($SiO_2$+CaO) and an (Al+Cr) content of more than 0.13% by weight as ($A_2O_3$+$Cr_2O_3$), they had poorer $(BH)_{max}$, iHc and magnetizability than those of Sample Nos. 1 to 3 with the same mixing ratios.

Figure 4:
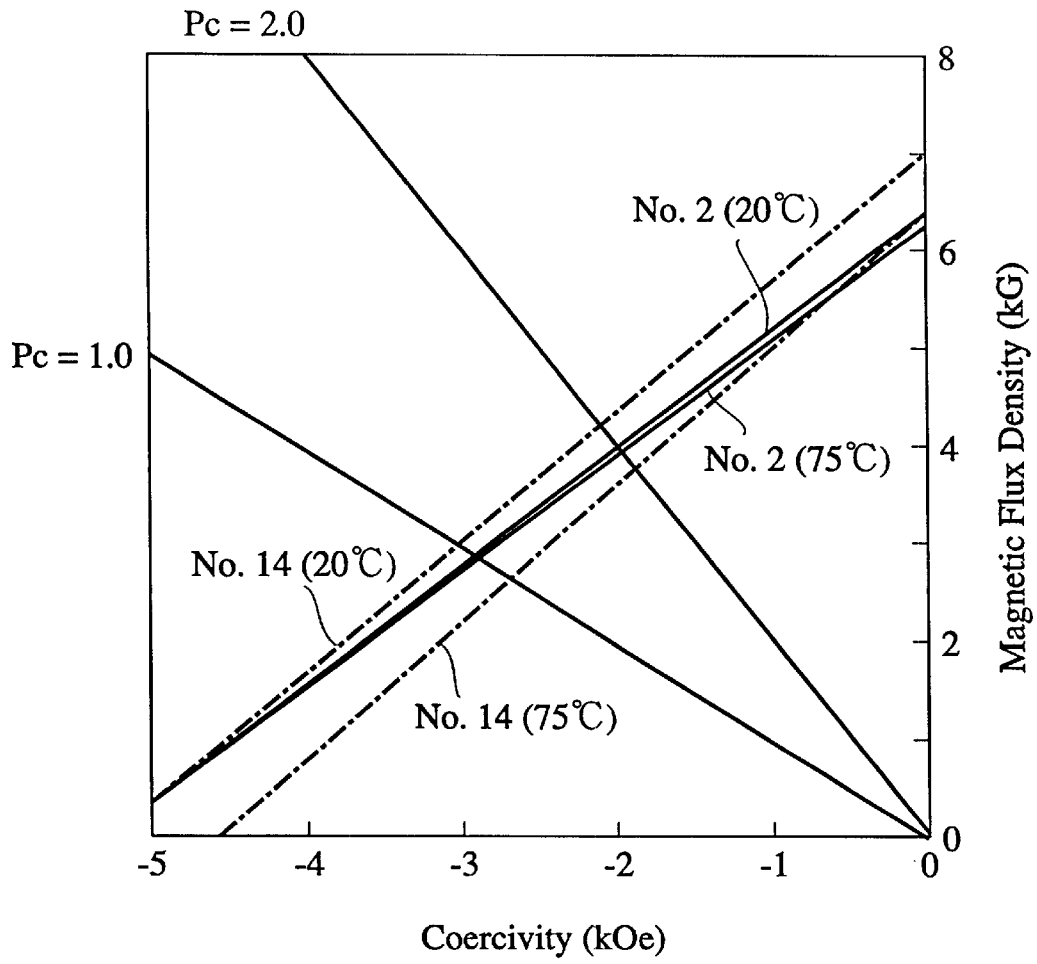
FIG. 4 is a graph showing the B-H demagnetization curves of Sample Nos. 2 and 14 at 20° C. and 75° C.

FIG. 4 shows the B-H demagnetization curves of the anisotropic, resin-bonded magnet of Sample No. 2 of Example 1 and the isotropic resin-bonded magnet of Sample No. 14 of Comparative Example 4 at 20° C. and 75° C., respectively. Determined from the B-H demagnetization curves of FIG. 4 were the change of a magnetic flux density (ΔBd) and a demagnetization coefficient both at Pc=1.0 and 2.0, respectively, when the temperature changed from 20° C. to 75° C. The results are shown in Table 2.

$\Delta Bd = Bd_{20°\,C.} - Bd_{75°\,C.}$, and (Demagnetization coefficient)=$(\Delta Bd/Bd_{20°\,C.}) \times 100$ (%).

TABLE 2

| Resin-Bonded | 20° C. → 75° C. ΔBd (G) | | 20° C. → 75° C. Demagnetization Coefficient (%) | |
|---|---|---|---|---|
| Magnet | Pc = 1 | Pc = 2 | Pc = 1 | Pc = 2 |
| Sample No. 2 (Ref. Ex. 1) | 65 | 75 | 2.3 | 1.9 |
| Sample No. 14 (Com. Ex. 4) | 335 | 420 | 11.4 | 11.2 |

As is clear from Table 2, the anisotropic, resin-bonded magnet of Sample No. 2 (Reference Example 1) was superior to the isotropic resin-bonded magnet of Sample No. 14 (Comparative Example 4) in both ΔBd and demagnetization coefficient. The isotropic resin-bonded magnet of Sample No. 14 particularly showed a demagnetization coefficient of more than 10%.

REFERENCE EXAMPLE 5

Production of Second Ferrite Magnet Powder

The calcined coarse powder in Reference Example 1 was finely pulverized by a wet attritor (solvent: water) to have an average particle size of 0.9 μm as measured by an air permeation method using a Fischer Subsieve sizer. The resultant fine powder slurry was subjected to wet compression molding in a parallel magnetic field of 10 kOe to obtain a molded product. The molded product was demagnetized, heated to 100° C. in the air to remove water, and then cooled. The dried molded product was crushed by a jaw crusher and then classified to obtain a magnet powder having particle sizes of 2 to 400 μm (as measured by HEROS RODOS SYSTEM). The magnet powder was heat-treated in the air for 1 hour at six levels of temperatures, 750° C., 800° C., 850° C., 900° C., 950° C. and 1,000° C., respectively. Thereafter, by the same procedure as in Reference Example 1, immersion in water, drying by heating and disintegration by sieving were conducted to obtain anisotropic, granulated powder (second ferrite magnet powder). Of these powders, those having an average particle size of 3 μm were measured with respect to magnetic properties at room temperature by a VSM.

The measurement was carried out by the following procedure. First, each anisotropic, granulated powder obtained at various heat treatment temperatures and a wax were charged into a VSM holder at a constant ratio at a constant total weight and set at the VSM. The holder was sealed tightly. While applying a parallel magnetic field of 6 kOe, the VSM was heated to melt the wax and then cooled to solidify the wax and fix the magnet powder. In this state, a demagnetization curve was drawn at room temperature to determine Br and iHc corrected to a state of 100% magnet powder.

Figure 6:
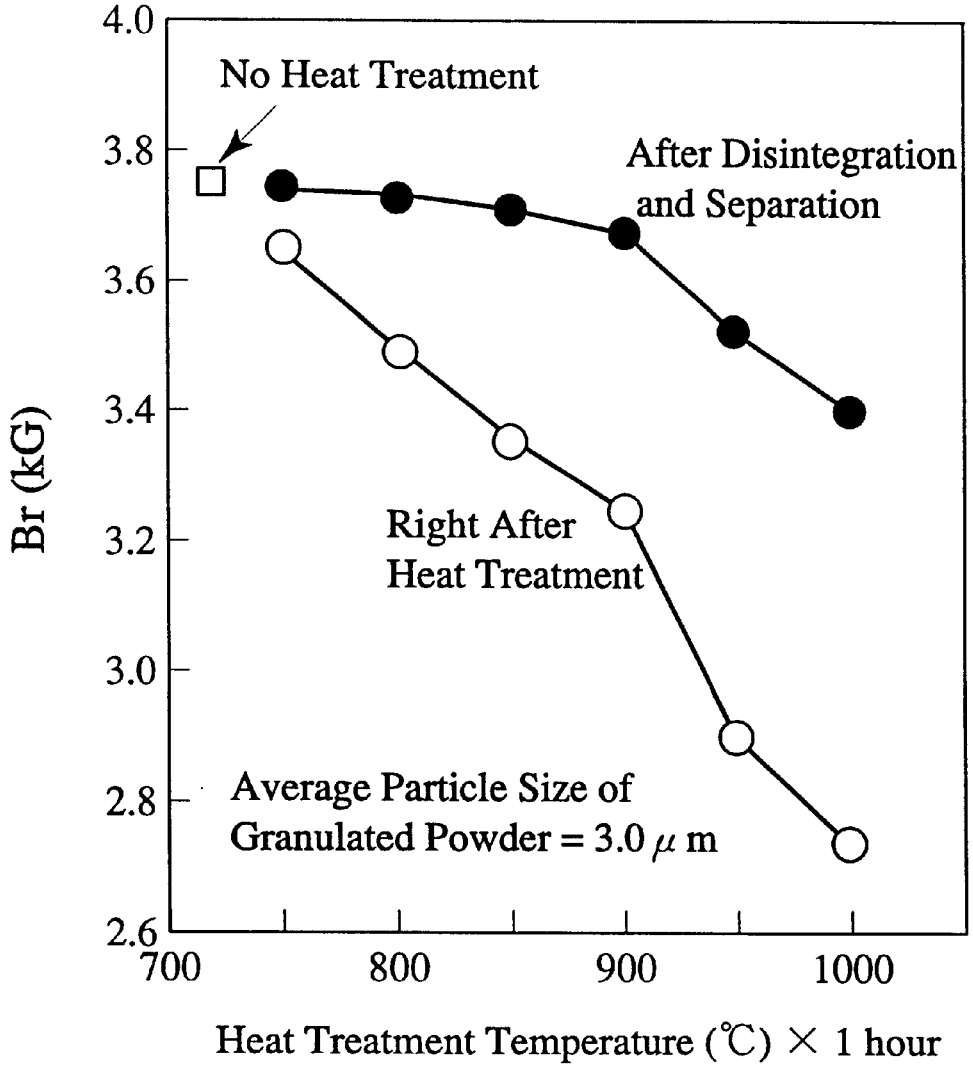
FIG. 6 is a graph showing the relations between residual magnetic flux density Br and heat treatment temperature in the second ferrite magnet powder in Reference Example 5.
Figure 7:
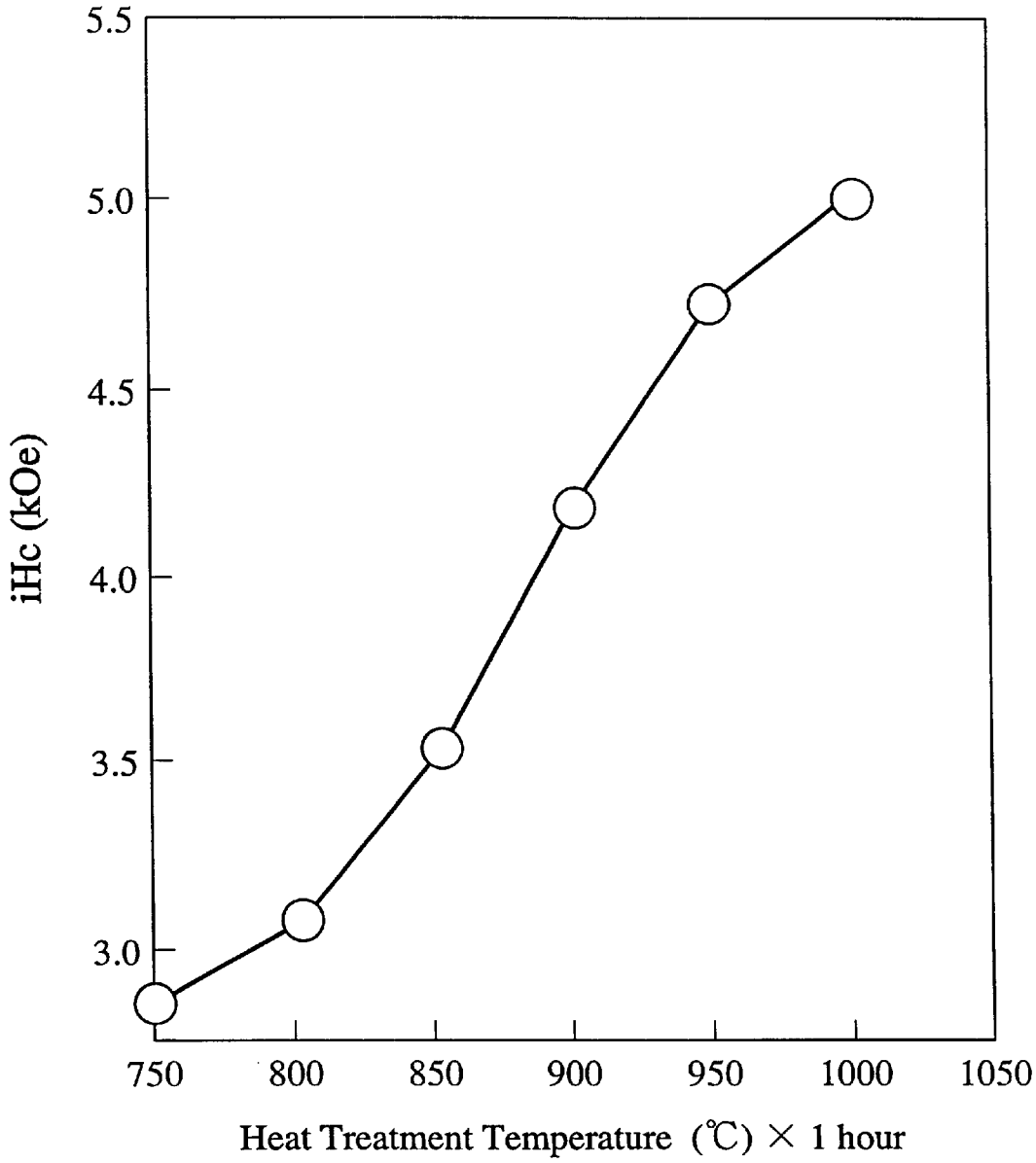
FIG. 7 is a graph showing the relations between coercivity iHc and heat treatment temperature in the second ferrite magnet powder in Reference Example 5.

The measurement results are shown in FIGS. 6 and 7. As shown in FIGS. 6 and 7, when the heat treatment temperature was 750–950° C., Br of 3.5–3.75 kG and iHc of 2.85–4.75 kOe were obtained.

Production of Anisotropic, Resin-bonded Magnets

A predetermined amount of the anisotropic, granulated powder (second ferrite magnet powder) having an average particle size of 3 μm obtained above by a heat treatment of 900° C.×1 hour was charged into a Henschel mixer. 0.25% by weight, based on the anisotropic, granulated powder, of aminosilane (KBM-603 available from Shin-Etsu Chemical Co., Ltd.) was added thereto while stirring, followed by mixing. The mixed powder was heated in the air at 80° C. for 3 hours and then cooled to room temperature, whereby the anisotropic, granulated powder was surface-treated. The same R—T—N-based magnet powder as in Reference Example 1 was also subjected to the same surface treatment as for the second ferrite magnet powder.

Figure 3:
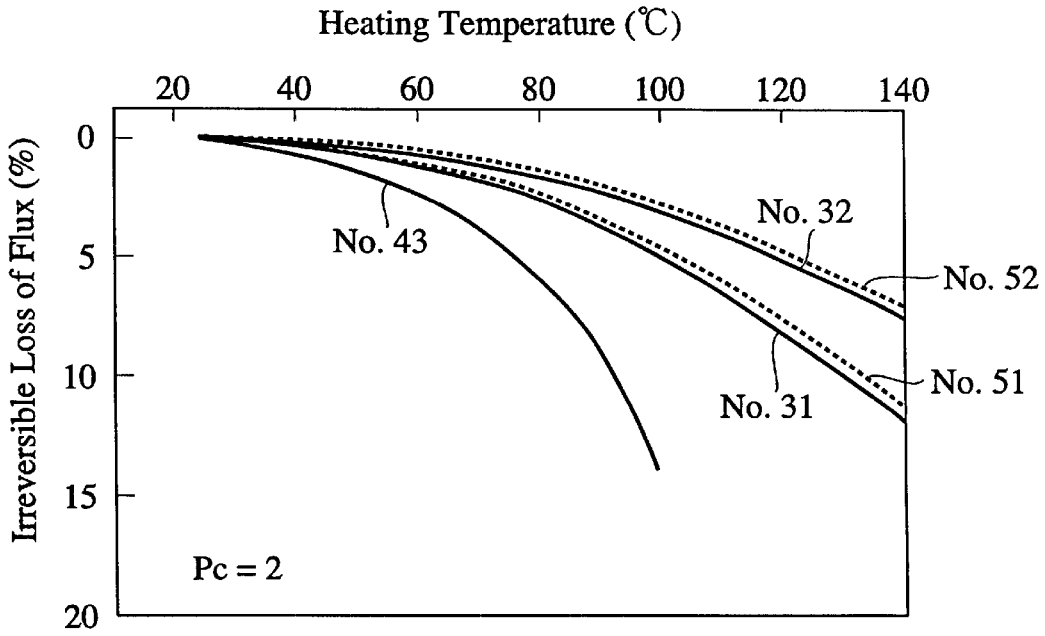
FIG. 3 is a graph showing the relations between irreversible loss of flux and heating temperature in Sample Nos. 31, 32, 43, 51 and 52.

Next, two types of the surface-treated magnet powders obtained above were compounded at weight ratios of 20/80, 50/50 and 80/20, respectively, and mixed by a mixer to prepare three types of mixed magnet powders. Each mixed magnet powder and nylon 12 (P-3014U available from Ube Industries, Ltd.) were compounded at a volume ratio of 60/40 (as converted to true density). Added to 100 parts by weight of each of the resultant compounds was 0.4 part by weight of stearamide (AP-1 available from Nippon Kasei Chemical Co., Ltd.) to prepare three compounds, which were mixed by a mixer and kneaded by a double-screw kneader of 230–280° C. in an Ar atmosphere to produce three types of compound pellets with different mixing ratios. Each type of pellets was charged into an injection-molding die and subjected to injection molding (injection temperature: 280° C., injection pressure: 1,000 kgf/cm$^2$) in a parallel magnetic field of 5 kOe to obtain three types of anisotropic, resin-bonded magnets as Sample Nos. 31 to 33. The resultant resin-bonded magnets were measured with respect to magnetic properties in the same manner as in Example 1. The results are shown as Sample Nos. 31 to 33 in Table 3. The measurement results of irreversible loss of flux of Sample Nos. 31 and 32 are shown in FIG. 3.

COMPARATIVE EXAMPLE 7

The R—T—N-based magnet powder obtained in Reference Example 1 and the same nylon 12 as in Reference Example 5 were compounded at a volume ratio of 60/40 (as converted to true density). Added to 100 parts by weight of the resultant compound was 0.4 part by weight of stearamide, followed by mixing by a mixer. Thereafter, compound pellets were produced, and an anisotropic, resin-bonded magnet was produced therefrom and measured with respect to properties in the same manner as in Reference Example 5. The results are shown as Sample No. 41 in Table 3.

COMPARATIVE EXAMPLE 8

Compound pellets were produced, and an anisotropic, resin-bonded magnet was produced therefrom and measured with respect to properties in the same manner as in Comparative Example 7 except for using only the second ferrite magnet powder of Reference Example 5 as a magnet powder. The results are shown as Sample No. 42 in Table 3.

COMPARATIVE EXAMPLE 9

Compound pellets were produced, and an anisotropic, resin-bonded magnet was produced therefrom and measured with respect to properties in the same manner as in Comparative Example 7 except for using only MQA-T of MQI Co. as a magnet powder. The results are shown as Sample No. 43 in Table 3.

COMPARATIVE EXAMPLE 10

An isotropic, resin-bonded magnet was produced and measured with respect to properties in the same manner as in Comparative Example 7 except for producing compound pellets using only MQP-B of MQI Co. as a magnet powder and molding them without a magnetic field. The results are shown as Sample No. 44 in Table 3.

COMPARATIVE EXAMPLE 11

The R—T—N-based magnet powder of Reference Example 1 and the Sr ferrite magnet powder of Comparative Example 5 were mixed at weight ratios of 20/80, 50/50 and 80/20, respectively. Thereafter, three types of compound pellets were produced, and three types of anisotropic, resin-bonded magnets were produced therefrom and measured with respect to properties in the same manner as in Example 5. The results are shown as Sample Nos. 45 to 47 in Table 3.

REFERENCE EXAMPLE 6

An anisotropic, granulated powder of a second ferrite magnet powder having an average particle size of 50 $\mu$m and a basic composition represented by $(Sr_{0.77}La_{0.23})O.n[(Fe_{0.983}Co_{0.0085}Zn_{0.0085})_2O_3]$ and heat-treated at 900° C. for 1 hour was produced in the same manner as in Reference Example 5 except for using the calcined coarse powder of Reference Example 4. This second ferrite magnet powder had an (Si+Ca) content of 0.130% by weight as ($SiO_2$+CaO) and an (Al+Cr) content of 0.081% by weight as ($Al_2O_3$+$Cr_2O_3$).

The second ferrite magnet powder was surface-treated with 0.25% by weight of aminosilane, and compounded with the same surface-treated R—T—N-based magnet powder as in Reference Example 5, at a weight ratio of 50/50. Thereafter, compound pellets were produced, and an anisotropic, resin-bonded magnet was produced therefrom and measured with respect to properties in the same manner as in Reference Example 5. The results are shown as Sample No. 34 in Table 3.

TABLE 3

| | Sample No. | Magnetic Powder Compounded (wt. %) | | $(BH)_{max}$ (MGOe) | iHc (kOe) | Magnetizability (%) | Heat-Resistant Temp. (° C.) |
|---|---|---|---|---|---|---|---|
| Ref. Ex. 5 | 31 | R-T-N (80) | Second Ferrite (20) | 10.1 | 8.7 | 78 | 100 |
| | 32 | R-T-N (50) | Second Ferrite (50) | 6.2 | 8.4 | 81 | 120 |
| | 33 | R-T-N (20) | Second Ferrite (80) | 3.2 | 7.9 | 87 | 140 |
| Ref. Ex. 6 | 34 | R-T-N (50) | Second Ferrite** (50) | 6.4 | 6.5 | 82 | 115 |
| Com. Ex. 7 | 41 | R-T-N (100) | — | 13.4 | 8.8 | 69 | 80 |
| Com. Ex. 8 | 42 | — | Second Ferrite (100) | 1.7 | 5.1 | 94 | <140* |
| Com. Ex. 9 | 43 | MQA-T (100) | — | 7.3 | 7.0 | 35 | 75 |
| Com. Ex. 10 | 44 | MQP-B (100) | — | 5.5 | 7.3 | 21 | 100 |
| Com. Ex. 11 | 45 | R-T-N (80) | Sr Ferrite (20) | 8.0 | 7.3 | 78 | 90 |
| | 46 | R-T-N (50) | Sr Ferrite (50) | 4.9 | 5.3 | 81 | 110 |
| | 47 | R-T-N (20) | Sr Ferrite (80) | 2.9 | 4.1 | 87 | 130 |

As is clear from Table 3, Sample Nos. 31 to 34 of Examples 5 and 6 had improved magnetizability and heat-resistant temperature than those of Sample No. 41 of Comparative Example 7. In contrast, the sample of Comparative Example 8 had very low $(BH)_{max}$, and the samples of Comparative Examples 9 and 10 had poor magnetizability. The comparison of Reference Examples 5 and 6 with Comparative Example 11 revealed that Reference Examples 5 and 6 were improved in $(BH)_{max}$, iHc and heat-resistant temperature than Comparative Example 11 at the same mixing ratio.

EXAMPLE 7

Production of Third Ferrite Magnet Powder

The same $SrCO_3$ powder and high-purity recycled iron oxide ($\alpha$-$Fe_2O_3$) powder as in Reference Example 1 were compounded to have a basic composition represented by $SrO.5.9Fe_2O_3$ and then wet-mixed. The resultant mixture was calcined at 1,250° C. for 2 hours in the air. The resultant calcined powder was dry-pulverized by a roller mill to obtain a coarse powder, which was then subjected to wet fine pulverization by an attritor to obtain a slurry containing a fine powder having an average particle size of 0.6 $\mu$m as measured by an air permeation method using a Fischer Subsieve sizer. At the initial stage of the fine pulverization, the same $La_2O_3$ powder and Co oxide powder as in Reference Example 1 and a $Fe_3O_4$ magnetite powder having a purity higher than 99.0% were added at weight ratios of 2.5%, 1.2% and 6.0%, respectively, relative to the coarse powder. Simultaneously, $SrCO_3$, $CaCO_3$ and $SiO_2$ were added as a sintering aid at weight ratios of 0.3%, 1.0% and 0.3%, respectively, relative to the fine powder. The resultant fine powder slurry was subjected to wet compression molding in a parallel magnetic field of 10 kOe to obtain a cylindrical molded product of 25 mm in outer diameter and 10 mm in thickness. The molded product was sintered at 1,200° C. for 2 hours. The resultant sintered ferrite material had the following basic composition:

$$(Sr_{1-x}La_x)O.n[(Fe_{1-y}Co_y)_2O_3] \text{ by atomic \%}$$

wherein x=2ny, x=0.15, and n=5.55.

The sintered ferrite material was coarsely pulverized and then subjected to dry pulverization by a roller mill to obtain a coarse powder. The coarse powder was pulverized by a dry ball mill to have an average particle size of 3.1 μm (measured by HEROS RODOS SYSTEM) and then heat-treated at 830° C. for 2 hours. The heat-treated powder was charged into a mixer filled with water, and the resultant mixture was stirred at 60 rpm for 30 seconds for disintegration. Thereafter, the mixture was heated to 80° C. to remove water and cooled to room temperature to obtain a sintered ferrite magnet powder (a third ferrite magnet powder). The sintered ferrite magnet powder contained Si and Ca in amounts of 0.33% by weight as $SiO_2$ and 0.60% by weight as CaO, respectively. The sintered ferrite magnet powder also contained Al+Cr in an amount of 0.075% by weight as ($Al_2O_3$+$Cr_2O_3$).

Production of Anisotropic, Resin-bonded Magnets

A predetermined amount of the above third ferrite magnet powder was charged into a Henschel mixer. 0.25% by weight, based on the third ferrite magnet powder, of aminosilane (KBM-603 available from Shin-Etsu Chemical Co., Ltd.) was added thereto while stirring, followed by mixing. The mixed powder was heated at 80° C. for 3 hours in the air and then cooled to room temperature, whereby a surface treatment was conducted for the third ferrite magnet powder. The same R—T—N-based magnet powder as in Example 1 was also subjected to the same surface treatment as for the third ferrite magnet powder.

The two types of the surface-treated magnet powders obtained above were compounded at weight ratios of 20/80, 50/50 and 80/20, respectively, and then mixed by a mixer to prepare three types of mixed magnet powders. Each mixed magnet powder and nylon 12 (P-3014U available from Ube Industries, Ltd.) was compounded at a volume ratio of 60/40 (as converted to true density). Added to 100 parts by weight of each of the resultant compounds was 0.4 parts by weight of stearamide (AP-1 available from Nippon Kasei Chemical Co., Ltd.) to prepare three types of compound materials. Each material was mixed by a mixer and kneaded by a double-screw kneader of 230–280° C. in an Ar atmosphere to produce three types of compound pellets with different mixing ratios.

Each type of pellets was charged into an injection-molding die and injection-molded (injection temperature: 280° C., injection pressure: 1,000 kgf/cm$^2$) in a parallel magnetic field of 5 kOe to obtain three types of anisotropic, resin-bonded magnets as Sample Nos. 51 to 53. The magnets were measured with respect to magnetic properties in the same manner as in Reference Example 1. The results are shown as Sample Nos. 51 to 53 in Table 4. The measurement results of irreversible loss of flux of Sample Nos. 51 and 52 are shown in FIG. 3. As is clear from FIG. 3, Sample Nos. 51 and 52 had improved irreversible loss of flux than Sample Nos. 31 and 32 at the same mixing ratio.

COMPARATIVE EXAMPLE 12

An anisotropic, resin-bonded magnet was produced and measured with respect to properties in the same manner as in Example 7 except for using only the third ferrite magnet powder of Example 7 as a magnet powder. The results are shown as Sample No. 61 in Table 4. For reference, the data of Comparative Examples 7 and 9–11 are also shown in Table 4.

EXAMPLE 8

The same iron oxide powder, $SrCO_3$ powder, $La_2O_3$ powder, Co oxide powder and ZnO powder as in Example 4 were compounded to have a basic composition of $Sr_{0.80}La_{0.20}Fe_{11.70}Co_{0.10}Zn_{0.10}O_{18.85}$ after calcination. Added to the resultant compound were $SiO_2$ powder and $CaCO_3$ powder in amounts of 0.25% by weight and 0.2% by weight, respectively, relative to the compound, followed by wet mixing. The resultant mixture was calcined at 1,300° C. for 2 hours in the air. The calcined body was crushed and dry-coarse-pulverized by a roller mill to obtain a coarse powder, which was then subjected to wet fine pulverization by an attritor to obtain a slurry containing a fine powder having an average particle size of 0.7 μm as measured by an air permeation method using a Fischer Subsieve sizer. At the initial stage of the fine pulverization, $SrCO_3$ powder, $SiO_2$ powder, $CaCO_3$ powder and $La_2O_3$ powder were added as sintering aids in amounts of 0.25% by weight, 0.40% by weight, 0.8% by weight and 0.6% by weight, respectively, based on the total weight of the coarse powder used in the fine pulverization. The fine powder slurry obtained above was compression-molded in a parallel magnetic field of kOe to obtain a cylindrical molded product of 25 mm in outer diameter and 10 mm in thickness. The molded product was sintered at 1,200° C. for 2 hours to obtain an anisotropic, sintered ferrite magnet of La/(Co+Zn)=1.2 having the following basic composition:

$$(Sr_{o.77}La_{0.23})O.5.72[(Fe_{0.983}Co_{0.0085}Zn_{0.0085})_2O_3]$$

and containing Si, Ca and (Al+Cr) in amounts of 0.42% by weight as $SiO_2$, 0.59% by weight as CaO and 0.06% by weight as ($Al_2O_3$+$Cr_2O_3$), respectively.

The sintered body was crushed and dry-coarse-pulverized by a roller mill to obtain a coarse powder. The coarse powder was classified into 100-mesh and under to obtain a powder having an average particle size of 100 μm. The powder was heat-treated in the air at 850° C. for 3 hours and then cooled to room temperature. The heat-treated powder was classified into 100-mesh and under to break aggregation, thereby obtaining a third ferrite magnet powder.

The third ferrite magnet powder was surface-treated with 0.25% by weight of aminosilane. The resultant ferrite magnet powder and the same R—T—N-based magnet powder as in Example 7, which was subjected to the same surface treatment as above, were compounded at a weight ratio of 50/50. Thereafter, compound pellets were produced, and an anisotropic, resin-bonded magnet was produced therefrom and measured with respect to properties in the same as in Example 7. The results are shown as Sample No. 54 in Table 4.

TABLE 4

| | Sample No. | Magnetic Powder Compounded (wt. %) | | $(BH)_{max}$ (MGOe) | iHc (kOe) | Magnetizability (%) | Heat-Resistant Temp. (° C.) |
|---|---|---|---|---|---|---|---|
| Ex. 7 | 51 | R-T-N (80) | Third Ferrite (20) | 10.5 | 8.7 | 78 | 110 |

TABLE 4-continued

| | Sample No. | Magnetic Powder Compounded (wt. %) | | $(BH)_{max}$ (MGOe) | iHc (kOe) | Magnetizability (%) | Heat-Resistant Temp. (° C.) |
|---|---|---|---|---|---|---|---|
| | 52 | R-T-N (50) | Third Ferrite (50) | 6.4 | 8.5 | 81 | 130 |
| | 53 | R-T-N (20) | Third Ferrite (80) | 3.4 | 8.0 | 87 | <140* |
| Ex. 8 | 54 | R-T-N (50) | Third Ferrite** (50) | 6.7 | 6.6 | 82 | 120 |
| Com. Ex. 7 | 41 | R-T-N (100) | — | 13.4 | 8.8 | 69 | 80 |
| Com. Ex. 12 | 61 | — | Third Ferrite (100) | 1.9 | 5.4 | 94 | <140* |
| Com. Ex. 9 | 43 | MQA-T (100) | — | 7.3 | 7.0 | 35 | 75 |
| Com. Ex. 10 | 44 | MQP-B (100) | — | 5.5 | 7.3 | 21 | 100 |
| Com. Ex. 11 | 45 | R-T-N (80) | Sr Ferrite (20) | 8.0 | 7.3 | 78 | 90 |
| | 46 | R-T-N (50) | Sr Ferrite (50) | 4.9 | 5.3 | 81 | 110 |
| | 47 | R-T-N (20) | Sr Ferrite (80) | 2.9 | 4.1 | 87 | 130 |

Notes:
* Less than 5% at 140° C.
** Zn-containing ferrite.

As is clear from Table 4, Sample Nos. 51 to 54 of Examples 7 and 8 had improved magnetizability and heat-resistant temperature than those of Sample No. 41 of Comparative Example 7. In contrast, the sample of Comparative Example 12 had very low $(BH)_{max}$, and the samples of Comparative Examples 9 and 10 had poor magnetizability. The comparison of Examples 7 and 8 with Comparative Example 11 revealed that Examples 7 and 8 were improved in $(BH)_{max}$, iHc and heat-resistant temperature than Comparative Example 11 at the same mixing ratio.

EXAMPLE 9

Production of Compounds

In order to produce long, radially anisotropic, ring-shaped, resin-bonded magnets for magnet rolls by extrusion molding in a magnetic field, the same R—T—N-based magnet powder as in Reference Example 1 was compounded with the first, second or third ferrite magnet powder of Reference Example 1, Reference Example 5 or Example 7 or with the Sr ferrite magnet powder of Comparative Example 5 in the following proportions to produce four types of compounds A, B, C and D.

Compound A: A nylon 12-based compound comprising a 50/50 mixture of the R—T—N-based magnet powder and the second ferrite magnet powder produced in Reference Example 5.

Compound B: A nylon 12-based compound produced in the same manner as in Compound A except for using a 50/50 mixture of the R—T—N-based magnet powder and the first ferrite magnet powder produced in Reference Example 1.

Compound C: A nylon 12-based compound produced in the same manner as in Compound A except for using a 50/50 mixture of the R—T—N-based magnet powder and the third ferrite magnet powder produced in Example 7.

Compound D: A nylon 12-based compound produced in the same manner as in Compound A except for using a 50/50 mixture of the R—T—N-based magnet powder and the Sr ferrite magnet powder produced in Comparative Example 5.

Production and Evaluation of Radially Anisotropic, Cylindrical, Resin-bonded Magnets for Magnet Rolls Each compound A to D was charged into an extruder 6 heated at 230–280° C. shown in FIGS. 9 and 10. When the compound passed through an orienting die 7 at the front end of the extruder 6 in an Ar atmosphere, radial anisotropy was imparted to the compound. Each resultant cylindrical molded product was cooled, demagnetized, and cut to a predetermined length to obtain a molded product 88 having an outer diameter of 25 mm, an inner diameter of 22 mm and an axial length of 220 mm shown in FIG. 11(*a*). Forced into the central hole of the molded product 88 was a shaft 86 to constitute four types of magnet rolls 81. The outer surface of each magnet roll was magnetized in a magnetic field of 8 kOe to form asymmetrical four magnetic poles on the outer surface. Each of the resultant four types of cylindrical resin-bonded magnets 88 was measured with respect to the waveform of the surface magnetic flux density along the axial direction of the developing magnetic pole $N_1$ formed on the outer surface. Table 5 shows the data of each cylindrical resin-bonded magnet 88, i.e. an average value (relative value) of a surface magnetic flux density (Bo) measured with a 10-mm area excluded on each end and the unevenness of the surface magnetic flux density (ΔBo= maximum value of Bo—minimum value of Bo).

Figure 8A:
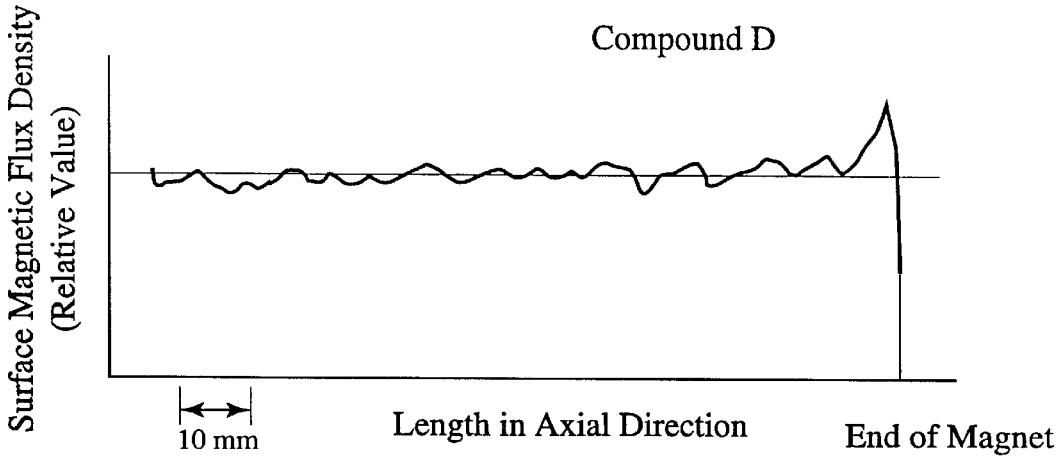
FIG. 8(*a*) is a graph showing the surface magnetic flux density distribution of the long, ring-shaped, resin-bonded, radial magnet produced by using Compound D in Example 9.
Figure 8B:
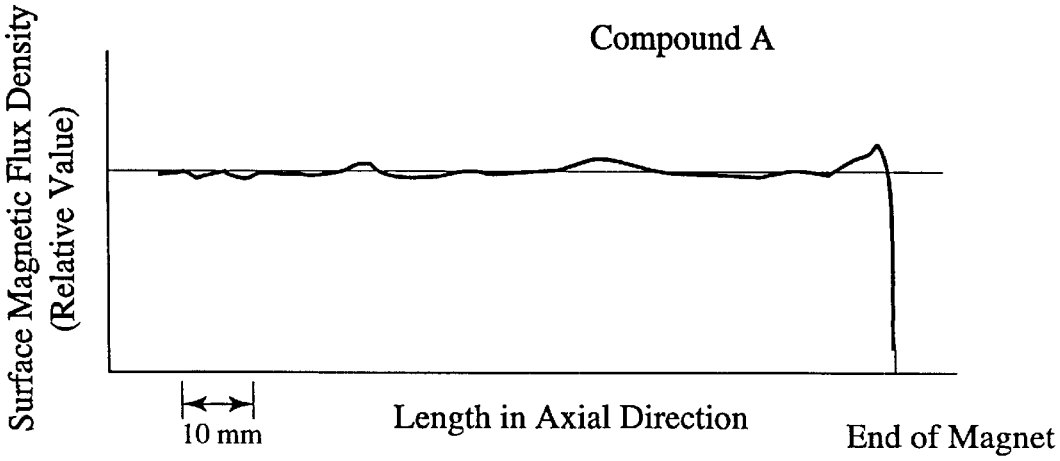

A radially anisotropic, cylindrical resin-bonded magnet having an outer diameter of 25 mm, an inner diameter of 22 mm and an axial length of 220 mm was produced using each compound D and A. A shaft was forced into the magnet, after which magnetization was conducted to form asymmetrical four magnetic poles. Each of the resultant radially anisotropic, cylindrical resin-bonded magnets was measured with respect to ΔBo. The results are shown in FIGS. 8(*a*) and 8(*b*).

Mounted onto the outer surface of each magnet roll 81 with a magnetic gap 95 was a non-magnetic, cylindrical sleeve 82 made of an aluminum alloy to form a developing roll 80. In the magnet roll 81, a closed magnetic circuit 90 shown by the dotted line in FIG. 11(*a*) was formed and a strong magnetic field was generated on the outer surface of the sleeve 82. By rotating the sleeve 82 with the magnetic roll 81 stationary, for example, a magnetic developer (not shown) was transferred to a developing region, a region where an image carrier (not shown) and the sleeve 82 faced each other, on the outer surface of the sleeve 82 to develop an electrostatic latent image.

TABLE 5

| Compound | Average Value of Bo (Relative Value) | ΔBo (G) |
|---|---|---|
| A | 94 | 20–50 |
| B | 100 | 30–100 |
| C | 96 | 20–50 |
| D | 88 | 30–100 |

As is clear from Table 5, when the compound B comprising an R—T—N-based magnet powder and a first ferrite magnet powder at the optimum ratio is used, improvement in the average value of Bo is obtained. More improved average value of Bo and smaller ΔBo are obtained when using the compound A or C than when using the compound D, reflecting the magnetic anisotropy of the ferrite magnet powder contained in the compound A or C. This is due to the fact that the average particle size of the ferrite magnet powder contained in the compound A or C is larger than that of the ferrite magnet powder contained in the compound D, and that therefore the compound A or C has improved flowability (moldability).

EXAMPLE 10

Production of Compounds

The same R—T—N-based magnet powder as in Example 1 was blended with the same first ferrite magnet powder as in Reference Example 4 or with the same third ferrite magnet powder as in Example 8 in the following proportions and the subsequent operation was conducted in the same manner as in Example 9 to produce the following two types of compounds E and F.

Compound E: A nylon 12-based compound comprising a 50/50 mixture of the R—T—N-based magnet powder and the first ferrite magnet powder (Reference Example 4).

Compound F: A nylon 12-based compound comprising a 50/50 mixture of the R—T—N-based magnet powder and the third ferrite magnet powder (Example 8).

Figure 12A:
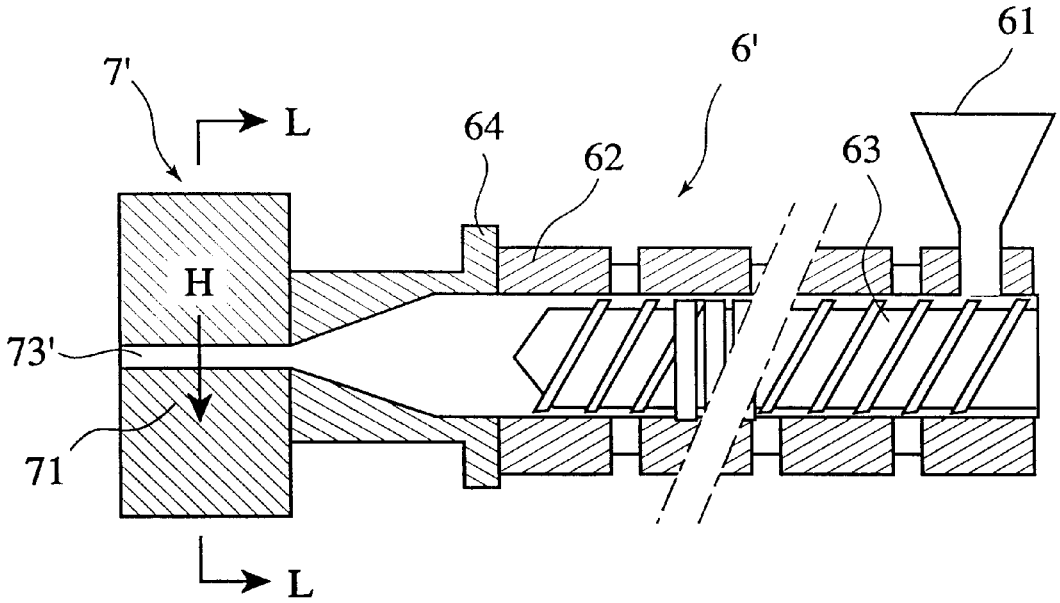
FIG. 12(*a*) is a cross-sectional view showing the whole structure of an extruder for producing a parallel-anisotropic, resin-bonded sheet magnet.
Figure 12B:
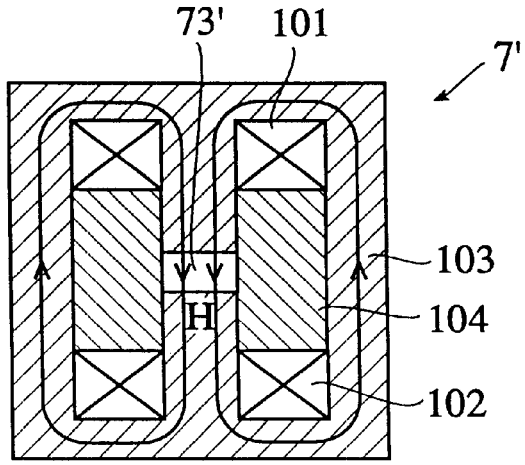

Production and Evaluation of Anisotropic, Sheet-shaped, Resin-bonded Magnets for Magnet Rolls Each compound B, C, E and F was charged into an extruder 6' shown in FIG. 12, which was heated at 230–280° C. in an Ar atmosphere. When the compound passed through an orienting die 7' at the front end of the extruder 6', a parallel magnetic field H of 8 kOe was applied to mold a sheet-shaped resin-bonded magnet of 2.0 mm in thickness and 2.5 mm in width having anisotropy in the thickness direction. The resultant four types of sheet-shaped molded products were cooled, demagnetized, and cut to a size of 2.0 mm in thickness, 2.5 mm in width and 220.0 mm in axial direction.

Figure 11A:
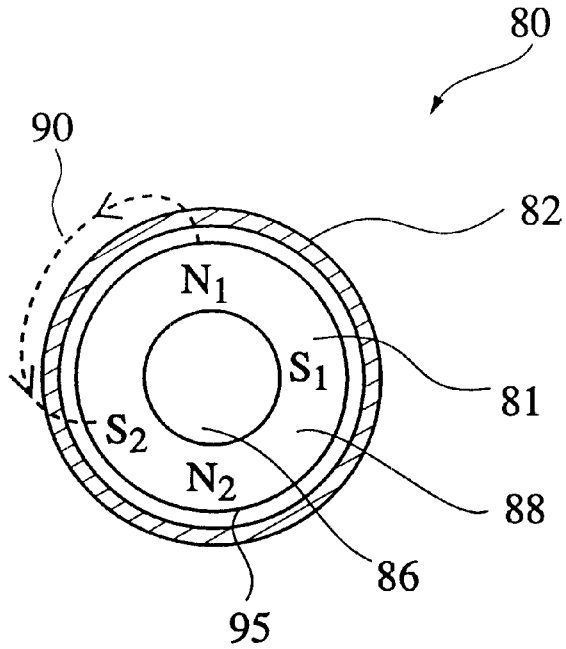
FIGS. 11(*a*) and (*b*) are cross-sectional views each showing a magnet roll.
Figure 11B:
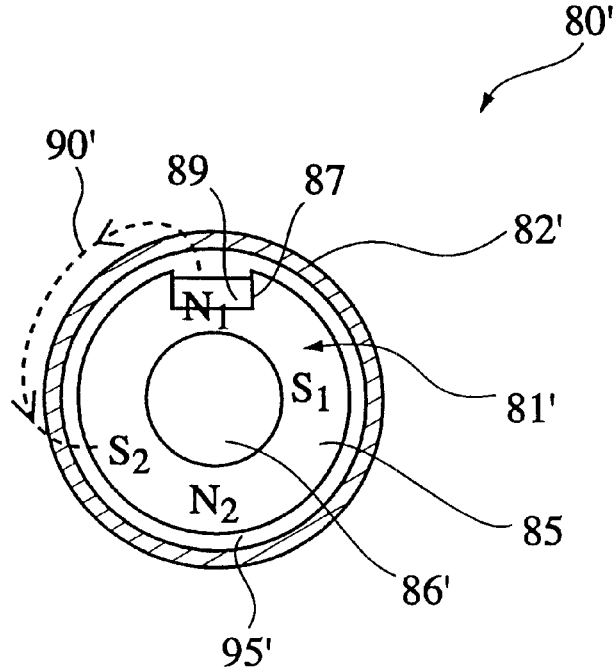

As shown in FIG. 11(*b*), each sheet-shaped, resin-bonded magnet 89 obtained above by cutting was fitted into a groove 87 on a polar-anisotropic, resin-bonded ferrite magnet 85 of 20.0 mm in outer diameter and 220.0 mm in axial length along the entire axial length, thereby providing the magnetic roll 81' with a developing magnetic pole $N_1$. A shaft 86' was forced into the central hole of the polar-anisotropic, resin-bonded ferrite magnet 85. Each of the four types of magnet rolls 81' obtained by fitting the sheet-shaped, resin-bonded magnet 89 to the ferrite resin-bonded magnet 85 was measured with respect to the waveform of a surface magnetic flux density along the axial direction of the developing magnetic pole $N_1$. Table 6 shows the data of each magnet roll, i.e. the average value (relative value) of a surface magnetic flux density (Bo) measured with a 10-mm area excluded on each end, and the unevenness of such a surface magnetic flux density (ΔBo=maximum value of Bo—minimum value of Bo).

Mounted onto the outer surface of each magnet roll 81' with a magnetic gap 95' was a non-magnetic, cylindrical sleeve 82' made of an aluminum alloy to form a developing roll 80'. In the magnet roll 81', a closed magnetic circuit 90' shown by the dotted line in FIG. 11(*b*) was formed to generate a strong magnetic field on the outer surface of the sleeve 82'.

FIG. 12(*b*) is a cross-sectional view taken along the L—L line in FIG. 12(*a*). In FIG. 12(*a*), the same numerals as in FIG. 9 refer to the same parts as in FIG. 9. An orienting die 7' was constituted by a ferromagnetic frame 103, non-magnetic members 104, upper coils 101, lower coils 102 and a cavity 73'. Magnetic flux generated by the coils 101 and 102 formed a closed magnetic circuit to generate a parallel magnetic field in the cavity 73'.

TABLE 6

| Compound | Average Value of Bo (Relative Value) | ΔBo (G) |
|---|---|---|
| B | 97 | 30–100 |
| C | 95 | 20–50 |
| E | 100 | 30–100 |
| F | 98 | 20–50 |

The comparison of the compound B with the compound F and the comparison of the compound C with the compound F in Table 6 reveal that the average value of Bo is increased when a compound contains a first or third ferrite magnet powder containing Zn in a proper amount.

REFERENCE EXAMPLE 11

Figure 5:
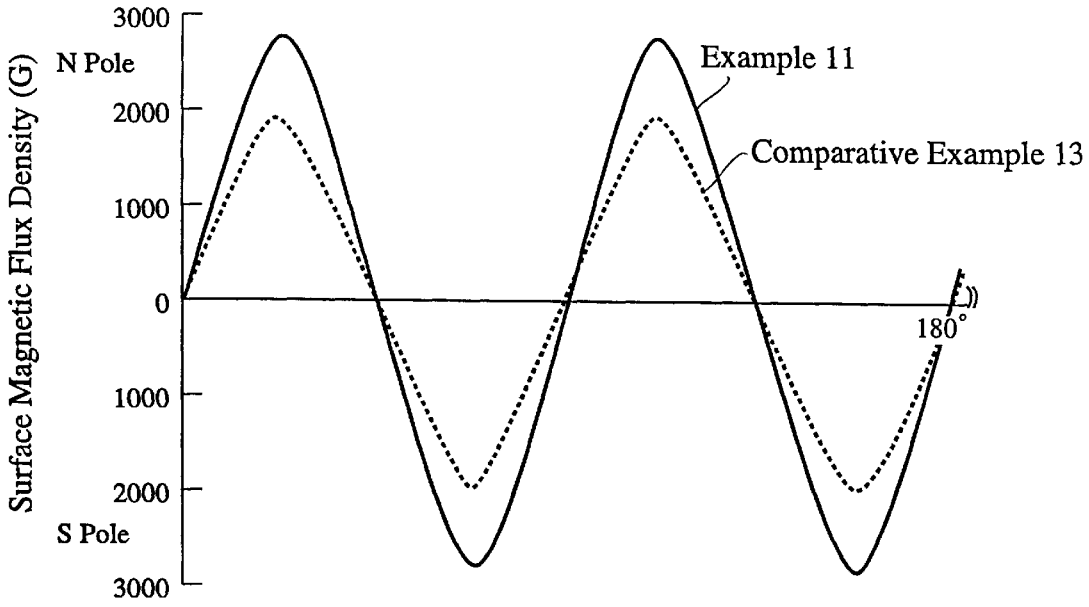
FIG. 5 is a graph showing the surface magnetic flux density distributions in Reference Example 11 and Comparative Example 13.

The same slurry as used in the production of the anisotropic, resin-bonded magnet of Sample No. 2 (Reference Example 1) was subjected to wet compression molding at a molding pressure of 8 tons/cm$^2$ at room temperature, using a compression molding machine having a cavity of 25 mm in outer diameter and 22 mm in inner diameter (outer diameter of core) and provided with a molding die with coils capable of generating a polar-anisotropic, orienting magnetic field of 4 kOe for forming symmetrical eight magnetic poles, thereby producing a polar-anisotropic, ring-shaped, molded product of 25 mm in outer diameter, 22 mm in inner diameter and 1.5 mm in axial length with symmetrical eight magnetic poles. The molded product was heated to 80° C. to remove the solvent and heated to 150° C. to obtain a polar-anisotropic, resin-bonded ring magnet (cured) having symmetrical eight magnetic poles. This resin-bonded magnet was magnetized along the polar-anisotropic direction in a magnetic field of kOe, and measured with respect to the waveform of a surface magnetic flux density in the circumferential direction of the outer surface. The results are shown in FIG. 5. As shown in FIG. 5, the maximum surface magnetic flux densities of the eight magnetic poles were as high as 2,700–2,750 G.

COMPARATIVE EXAMPLE 13

A polar-anisotropic, resin-bonded ring magnet of 25 mm in outer diameter, 22 mm in inner diameter and 1.5 mm in axial length having symmetrical eight magnetic poles was produced in the same manner as in Reference Example 11 except for using the slurry of Comparative Example 3. The resin-bonded magnet was measured with respect to the waveform of the surface magnetic flux density. The results are shown in FIG. 5. As shown in FIG. 5, the maximum surface magnetic flux densities of the eight magnetic poles were as low as 1,900 G.

REFERENCE EXAMPLE 12

The same third ferrite magnet powder as in Example 7 and the same R—T—N-based magnet powder as in Reference Example 1 were compounded at a weight ratio of 50/50, and the subsequent operation was conducted in the same manner as in Reference Example 1 to produce a slurry. This slurry was formed into a polar-anisotropic, resin-bonded ring magnet of 25 mm in outer diameter, 22 mm in inner diameter and 1.5 mm in axial length with symmetrical eight magnetic poles in the same manner as in Reference Example 11. This resin-bonded ring magnet was magnetized in a magnetic field of 10 kOe along the polar-anisotropic direction and then measured with respect to the waveform of a surface magnetic flux density in the circumferential direction of the outer surface. As a result, the maximum surface magnetic flux densities of the eight magnetic poles were 2,690–2,750 G.

REFERENCE EXAMPLE 13

The same slurry as in Reference Example 11 was subjected to wet compression molding at a molding pressure of 8 tons/cm$^2$ at room temperature, using a compression molding machine comprising a molding die having a cavity of 25 mm in outer diameter and 22 mm in inner diameter (outer diameter of core) and coils capable of generating a radial orienting magnetic field of 4 kOe, to produce a radially anisotropic, ring-shaped, molded product of 25 mm in outer diameter, 22 mm in inner diameter and 30 mm in axial length. The molded product was heated to 80° C. to remove the solvent and heated to 160° C. to obtain a radially anisotropic, resin-bonded ring magnet (cured). This resin-bonded magnet was magnetized in a magnetic field of 10 kOe to form symmetrical eight magnetic poles on the outer surface, and measured with respect to the waveform of a surface magnetic flux density in the circumferential direction of the outer surface. The maximum surface magnetic flux densities of the eight magnetic poles were 2,700–2,750 G.

EXAMPLE 14

In the same manner as in Reference Example 13 except for using the same slurry as in Example 12, a radially anisotropic, resin-bonded ring magnet of 25 mm in outer diameter, 22 mm in inner diameter and 30 mm in axial length was produced to measure the waveform of a surface magnetic flux density in the circumferential direction of the outer surface. The maximum surface magnetic flux densities of the eight magnetic poles were 2,680–2,750 G.

EXAMPLE 15

The same third ferrite magnet powder as in Example 8 and the same R—T—N-based magnet powder as in Reference Example 1 were compounded at a weight ratio of 50/50, and the subsequent operation was conducted in the same manner as in Reference Example 1 to produce a slurry. With this slurry, a radially anisotropic, resin-bonded ring magnet of 25 mm in outer diameter, 22 mm in inner diameter and 30 mm in axial length was produced in the same manner as in Reference Example 13. The resin-bonded magnet was magnetized to form symmetrical eight magnetic poles, and measured with respect to the waveform of a surface magnetic flux density in the circumferential direction of the outer surface. As a result, the maximum surface magnetic flux densities of the eight magnetic poles were 2,730–2,790 G.

COMPARATIVE EXAMPLE 14

A radially anisotropic, ring-shaped molded product of 25 mm in outer diameter, 22 mm in inner diameter and 30 mm in axial length was produced in the same manner as in Reference Example 13 except for using the slurry of Comparative Example 3, and measured with respect to the wave form of a surface magnetic flux density in the circumferential direction of the outer surface. As a result, the maximum surface magnetic flux densities of the eight magnetic poles were 1,850–1,900 G.

Rotors were constituted by the resin-bonded ring magnets of Reference Example 13 and Examples 14–15 and Comparative Example 14. Each rotor was assembled into a brushless DC motor, which was examined for maximum efficiency. In each brushless DC motor, the average air gap between the rotor and the stator was controlled to 0.3 mm to determine the maximum efficiency by the following formula:

Maximum efficiency (%)=maximum value of [output/input)×100] determined at 1,500 rpm or less, wherein input (W)=[current I (A) flowing through a stator winding]×[voltage V) applied], and output (W)=torque (kgf/cm)×number of revolutions (rpm)×0.01027.

As a result, it was found that the brushless DC motors comprising the resin-bonded ring magnets of Examples 13–15 had larger maximum efficiency by 0.7–1.3%, meaning that they had higher performance than those comprising the resin-bonded ring magnet of Comparative Example 14.

As described above, the present invention can provide a resin-bonded magnet having a maximum energy product $(BH)_{max}$ at least equal to those of anisotropic, sintered ferrite magnets, and better magnetizability and/or heat resistance and lower unevenness in a surface magnetic flux density than conventional rare earth resin-bonded magnets. The present invention can also provide ferrite magnet powder and compounds used for such a resin-bonded magnet; and a rotor and a magnet roll comprising such a resin-bonded magnet.

What is claimed is:

1. A ferrite magnet powder for resin-bonded magnets comprising powder obtained by disintegrating a sintered ferrite magnetic material, said sintered ferrite magnet powder having a substantially magnetoplumbite-type crystal structure and a basic composition represented by the following general formula:

$$(A_{1-x}R'_x)O.n[(Fe_{1-y}M_y)_2O_3] \text{ by atomic ratio,}$$

wherein A is Sr and/or Ba; R' is at least one element selected from the group consisting of rare earth elements including Y, La being indispensable; M is Co or Co and Zn; and x, y and n are numbers meeting the following conditions:

$$0.01 \leqq x \leqq 0.4,$$

$$0.005 \leqq y \leqq 0.04, \text{ and}$$

$$5.0 \leqq n \leqq 6.4.$$

2. The ferrite magnet powder for resin-bonded magnets according to claim 1, wherein said sintered ferrite magnet powder contains $SiO_2$ and CaO in amounts of 0.05–0.55% by weight and 0.35–1% by weight, respectively, based on 100% by weight of the sintered ferrite magnet powder.

3. The ferrite magnet powder for resin-bonded magnets according to claim 1 or 2, wherein said ferrite magnet powder has an average particle size of 2–300 μm and is used for molding in a magnetic field.

4. A compound for resin-bonded magnets composed substantially of:

(a) an R—T—N-based magnet powder having a basic composition of $R_\alpha T_{100-\alpha-\beta}N_\beta$, wherein R is at least one member selected from the group consisting of rare earth elements including Y; T is Fe or Fe and Co; and α and β satisfy $5 \leqq \alpha \leqq 20$ and $5 \leqq \beta \leqq 30$, respectively, by atomic %, (b) a ferrite magnetic powder for resin-bonded magnets comprising powder obtained by disintegrating a sintered ferrite magnetic material, said sintered ferrite magnetic powder having a substantially magnetoplumbite-type crystal structure and a basic composition represented by the following general formula:

$$(A_{1-x}R'_x)O.n[(Fe_{1-y}M_y)_2O_3] \text{ by atomic ratio,}$$

wherein A is Sr and/or Ba; R' is at least one element selected from the group consisting of rare earth elements including Y, La being indispensable; M is Co or Co and Zn; and x, y and n are numbers meeting the following conditions:

$0.01 \leqq x \leqq 0.4$, $0.005 \leqq y \leqq 0.04$, and $5.0 \leqq n \leqq 6.4$, and (c) a binder.

5. The compound for resin-bonded magnets according to claim 4, wherein said R—T—N-based magnet powder has an average particle size of 1–10 μm and said ferrite magnet powder has an average particle size of 0.9–2 μm.

6. A compound for resin-bonded magnets composed substantially of:

(a) an R—T—N-based magnetic powder having a basic composition of $R_\alpha T_{100-\alpha\beta}N_\beta$, wherein R is at least one element selected from the group consisting of rare earth elements including Y; T is Fe, or Fe and Co; α and β satisfy $5 \leqq \alpha \leqq 20$ and $5 \leqq \beta \leqq 30$, respectively, by atomic %, (b) a ferrite magnetic powder for resin-bonded magnets comprising powder obtained by disintegrating a sintered ferrite magnetic material, said sintered ferrite magnetic powder having a substantially magnetoplumbite-type crystal structure and a basic composition represented by the following general formula:

$$(A_{1-x}R'_x)O.n[(Fe_{1-y}M_y)_2O_3] \text{ by atomic ratio,}$$

wherein A is Sr and/or Ba' R' is at least one element selected from the group consisting of rare earth elements including Y, La being indispensable; M is Co, or Co and Zn; and x, y and n are numbers meeting the following conditions:

$0.01 \leqq x \leqq 0.4$, $0.005 \leqq y \leqq 0.04$, and $5.0 \leqq n \leqq 6.4$, and (c) a binder, wherein said R—T—N-based magnet powder has an average particle size of 1–10 μm, and said ferrite magnet powder is an anisotropic, granulated powder.

7. A compound for resin-bonded magnets, composed substantially of:

(a) an R—T—N-based magnetic powder having a basic composition of $R_\alpha T_{100-\alpha-\beta}N_\beta$, wherein R is at least one element selected from the group consisting of rare earth elements including Y; T is Fe, or Fe and Co; α and β satisfy $5 \leqq \alpha \leqq 20$ and $5 \leqq \beta \leqq 30$, respectively, by atomic %, (b) a ferrite magnetic powder for resin-bonded magnets comprising powder obtained by disintegrating a sintered ferrite magnetic material, said sintered ferrite magnetic powder having a substantially magnetoplumbite-type crystal structure and a basic composition represented by the following general formula:

$$(A_{100-x}R'_x)O.n[(Fe_{1-y}M_y)_2O_3] \text{ by atomic ratio,}$$

wherein A is Sr and/or Ba' R' is at least one element selected from the group consisting of rare earth elements including Y, La being indispensable; M is Co, or Co and Zn; and x, y and n are numbers meeting the following conditions:

$0.01 \leqq x \leqq 0.4$, $0.005 \leqq y \leqq 0.04$, and $5.0 \leqq n \leqq 6.4$, and (c) a binder, wherein said R—T—N-based magnet powder has an average particle size of 1–10 μm, and said ferrite magnet powder is an anisotropic, granulated powder.

8. A resin-bonded magnet composed substantially of:

(a) an R—T—N-based magnet powder having a basic composition of $R_\alpha T_{100-\alpha-\beta}N_\beta$, wherein R is at least one element selected from the group consisting of rare earth elements including Y; T is Fe or Fe and Co; and α and β satisfy $5 \leqq \alpha \leqq 20$ and $5 \leqq \beta \leqq 30$, respectively, by atomic %, (b) a ferrite magnetic powder for resin-bonded magnets comprising powder obtained by disintegrating a sintered ferrite magnetic material, said sintered ferrite magnetic powder having a substantially magnetoplumbite crystal structure and a basic composition represented by the following general formula:

$$(A_{1-x}R'_x)O.n[(Fe_{1-y}M_y)_2O_3] \text{ by atomic ratio,}$$

wherein A is Sr and/or Ba; R' is at least one element selected from the group consisting of rare earth elements including Y, La being indispensable; M is Co or Co and Zn; and x, y and n are numbers meeting the following conditions:

$0.01 \leqq x \leqq 0.4$, $0.005 \leqq y \leqq 0.04$, and $5.0 \leqq n \leqq 6.4$, and (c) a binder.

9. The resin-bonded magnet according to claim 8, wherein said R—T—N-based magnet powder has an average particle size of 1–10 μm, and said ferrite magnet powder is an anisotropic, granulated powder or an anisotropic sintered magnet powder, each having an average particle size of 2–300 μm.

10. The resin-bonded magnet according to claim 8, wherein said R—T—N-based magnet powder has an average particle size of 1–10 μm, and said ferrite magnet powder is an anisotropic, granulated powder and whose magnet has anisotropy imparted during molding in a magnetic field.

11. The resin-bonded magnet according to claim 8, wherein said R—T—N-based magnet powder has an average particle size of 1–10 μm, and said ferrite magnet powder is an anisotropic, sintered ferrite magnet powder and whose magnet has anisotropy imparted during molding in a magnetic field.

12. The resin-bonded magnet according to any one of claims 8–11, which has a ring shape, a cylindrical shape or an arc-segment shape.

13. The resin-bonded magnet according to any one of claims 8–11, which has radial or polar anisotropy.

14. A rotor constituted by a resin-bonded magnet composed substantially of:

(a) an R—T—N-based magnet powder having a basic composition of $R_{\alpha}T_{100-\alpha-\beta}N_{\beta}$, wherein R is at least one element selected from the group consisting of rare earth elements including Y; T is Fe or Fe and Co; and α and β satisfy $5 \leqq \alpha \leqq 20$ and $5 \leqq \beta \leqq 30$, respectively, by atomic %, (b) a ferrite magnetic powder for resin-bonded magnets comprising powder obtained by disintegrating a sintered ferrite magnetic material, said sintered ferrite magnetic powder having a substantially magnetoplumbite crystal structure and a basic composition represented by the following general formula:

$$(A_{1-x}R'_x)O.n[(Fe_{1-y}M_y)_2O_3] \text{ by atomic ratio,}$$

wherein A is Sr and/or Ba; R' is at least one element selected from the group consisting of rare earth elements including Y, La being indispensable; M is Co or Co and Zn; and x, y and n are numbers meeting the following conditions:

$0.01 \leqq x \leqq 0.4$, $0.005 \leqq y \leqq 0.04$, and $5.0 \leqq n \leqq 6.4$, and (c) a binder.

15. The rotor according to claim 14, wherein said R—T—N-based magnet powder has an average particle size of 1–10 μm, and said ferrite magnet powder is an anisotropic, granulated powder or an anisotropic, sintered ferrite magnet powder.

16. A magnet roll constituted by a resin-bonded magnet composed substantially of:

(a) an R—T—N-based magnet powder having a basic composition of $R_{\alpha}T_{100-\alpha-\beta}N_{\beta}$, wherein R is at least one element selected from the group consisting of rare earth elements including Y; T is Fe or Fe and Co; and α and β satisfy $5 \leqq \alpha \leqq 20$ and $5 \leqq \beta \leqq 30$, respectively, by atomic %, (b) a ferrite magnetic powder for resin-bonded magnets comprising powder obtained by disintegrating a sintered ferrite magnetic material, said sintered ferrite magnetic powder having a substantially magnetoplumbite crystal structure and a basic composition represented by the following general formula:

$$(A_{1-x}R'_x)O.n[(Fe_{1-y}M_y)_2O_3] \text{ by atomic ratio,}$$

wherein A is Sr and/or Ba; R' is at least one element selected from the group consisting of rare earth elements including Y, La being indispensable; M is Co or Co and Zn; and x, y and n are numbers meeting the following conditions:

$0.01 \leqq x \leqq 0.4$, $0.005 \leqq y \leqq 0.04$, and $5.0 \leqq n \leqq 6.4$, and (c) a binder.

17. The magnet roll according to claim 16, wherein said R—T—N-based magnet powder has an average particle size of 1–10 μm, and said ferrite magnet powder is an anisotropic, granulated powder or an anisotropic, sintered ferrite magnet powder.

* * * * *